US010408398B2

(12) United States Patent
Kim et al.

(10) Patent No.: US 10,408,398 B2
(45) Date of Patent: Sep. 10, 2019

(54) HOLDER AND LIGHTING DEVICE INCLUDING THE SAME

(71) Applicant: LG INNOTEK CO., LTD., Seoul (KR)

(72) Inventors: Jin Wook Kim, Seoul (KR); Yeo Jun Yun, Seoul (KR); Ji Hwan Jeon, Seoul (KR); Young Kuk Kwak, Seoul (KR); Bu Kwan Je, Seoul (KR); Gyung Mok Woo, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 543 days.

(21) Appl. No.: 15/079,600

(22) Filed: Mar. 24, 2016

(65) Prior Publication Data

US 2016/0281940 A1 Sep. 29, 2016

(30) Foreign Application Priority Data

Mar. 25, 2015 (KR) ..... 10-2015-0041684
Mar. 26, 2015 (KR) ..... 10-2015-0042470
Mar. 26, 2015 (KR) ..... 10-2015-0042471

(51) Int. Cl.
*F21K 9/20* (2016.01)
*F21S 8/02* (2006.01)
(Continued)

(52) U.S. Cl.
CPC ..... *F21S 8/04* (2013.01); *F21K 9/20* (2016.08); *F21S 8/026* (2013.01); *F21V 7/00* (2013.01);
(Continued)

(58) Field of Classification Search
CPC ..... F21Y 2101/00; F21Y 2115/10; F21V 19/003; F21V 19/0035; F21V 19/0045;
(Continued)

(56) References Cited

U.S. PATENT DOCUMENTS 4,770,384 A * 9/1988 Kuwazima ..... F16M 11/10 248/280.11
8,523,409 B1 * 9/2013 Drake ..... F21S 8/02 362/294
(Continued)

FOREIGN PATENT DOCUMENTS

GB 2 452 637 3/2009
GB 2 495 702 4/2013
(Continued)

OTHER PUBLICATIONS

European Search Report dated May 10, 2016 issued in Application No. 16158881.9.

*Primary Examiner* — Erin Kryukova
(74) *Attorney, Agent, or Firm* — KED & Associates, LLP

(57) ABSTRACT

A holder and a lighting device including the holder are provided. The holder may include a holder body having a hole, an outlet provided in a side of the holder body, and a channel provided in the holder body to connect the hole with the outlet. The channel may include a first channel provided in a circumferential direction and having one side connected to the outlet, a second channel that guides one of two wires connected to a light source module to the first channel, and a third channel that guides another one of the two wires to the first channel.

17 Claims, 24 Drawing Sheets

(51) Int. Cl.

| | |
|---|---|
| ***F21S 8/04*** | (2006.01) |
| ***F21V 7/00*** | (2006.01) |
| ***F21V 19/00*** | (2006.01) |
| ***F21V 21/03*** | (2006.01) |
| ***F21V 23/00*** | (2015.01) |
| ***F21V 29/71*** | (2015.01) |
| ***F21V 29/75*** | (2015.01) |
| ***F21V 29/77*** | (2015.01) |
| ***F21Y 101/00*** | (2016.01) |
| ***F21Y 115/10*** | (2016.01) |

(52) U.S. Cl.
CPC ..... *F21V 19/003* (2013.01); *F21V 19/0035* (2013.01); *F21V 19/0045* (2013.01); *F21V 21/03* (2013.01); *F21V 23/001* (2013.01); *F21V 23/002* (2013.01); *F21V 29/713* (2015.01); *F21V 29/75* (2015.01); *F21V 29/77* (2015.01); *F21V 19/0055* (2013.01); *F21V 29/773* (2015.01); *F21Y 2101/00* (2013.01); *F21Y 2115/10* (2016.08)

(58) Field of Classification Search
CPC .... F21V 19/0055; F21V 23/06; F21V 23/001; F21V 23/002; F21V 23/091; F21V 29/77; F21V 29/75; F21V 29/713; F21V 29/773; F21V 29/10; F21V 29/004; F21V 21/03; F21V 7/00; F21V 29/74; F21V 29/745; F21V 29/76; F21V 29/763; F21S 8/04; F21S 8/026; F21K 9/20
See application file for complete search history.

(56) References Cited

U.S. PATENT DOCUMENTS

D718,848 S * 12/2014 Norberg ..... D23/314
2006/0215408 A1* 9/2006 Lee ..... F21V 9/08 362/294
2006/0290891 A1* 12/2006 Wang ..... G03B 21/16 353/52
2007/0253201 A1* 11/2007 Blincoe ..... F21V 23/02 362/294
2009/0251898 A1* 10/2009 Kinnune ..... F21V 29/004 362/249.02
2010/0226131 A1* 9/2010 Higuchi ..... F21S 8/02 362/297
2011/0063849 A1* 3/2011 Alexander ..... F21V 19/001 362/294
2011/0210664 A1* 9/2011 Hisayasu ..... F21V 19/0055 315/32
2012/0106176 A1* 5/2012 Lopez ..... F21K 9/00 362/382
2012/0224375 A1* 9/2012 Zaderej ..... F21K 9/00 362/249.02
2012/0293997 A1 11/2012 Zaderej
2012/0305230 A1* 12/2012 Breen, IV ..... F21V 19/0005 165/185
2013/0294077 A1* 11/2013 Gabrius ..... F21S 8/026 362/241
2013/0314921 A1* 11/2013 Chen ..... F21V 25/12 362/249.02
2014/0029258 A1 1/2014 Schroll et al.
2014/0063814 A1* 3/2014 McGowan ..... F21V 7/00 362/308
2014/0153260 A1* 6/2014 Wronski ..... F21V 7/00 362/373
2015/0131301 A1 5/2015 Ho
2016/0178286 A1* 6/2016 Piarkiev ..... F21V 29/745 362/458

FOREIGN PATENT DOCUMENTS

| | | |
|---|---|---|
| TW | M 472152 | 2/2014 |
| WO | WO 2013/131092 | 9/2013 |
| WO | WO 2014/030277 | 2/2014 |

* cited by examiner (a)

(b)

HOLDER AND LIGHTING DEVICE INCLUDING THE SAME

CROSS-REFERENCE TO RELATED APPLICATION

This application claims priority under 35 U.S.C. § 119 to Korean Patent Application Nos. 2015-0041684, filed on Mar. 25, 2015, No. 2015-0042470, filed on Mar. 26, 2015, and No. 2015-0042471, filed on Mar. 26, 2015, whose entire disclosures are incorporated herein by reference.

BACKGROUND

1. Field

Embodiments relate to a holder and a light device including the same.

2. Background

Light emitting diodes (LED), due to their advantages in output, efficiency, and reliability, have been aggressively researched and developed not only as back lights of display devices but also as high-output and high-efficiency light sources for various lighting devices. Such LEDs may provide a high output while increasing light efficiency and reducing manufacturing costs.

To provide high efficiency, high reliability, and electrical properties, in addition to thermal and optical reliability, LED light sources may have a structure that transfers currents to light sources. Thus, LED light sources may be electrically connected to a power supply to receive currents. Wires or leads may be used, but there may be difficulties in assembly and arrangement due to a complicated structure of wires or leads. For example, when power is supplied through wires, it may be difficult to arrange the wires due to a structure thereof.

BRIEF DESCRIPTION OF THE DRAWINGS

The embodiments will be described in detail with reference to the following drawings in which like reference numerals refer to like elements wherein.

DETAILED DESCRIPTION

Figure 1:
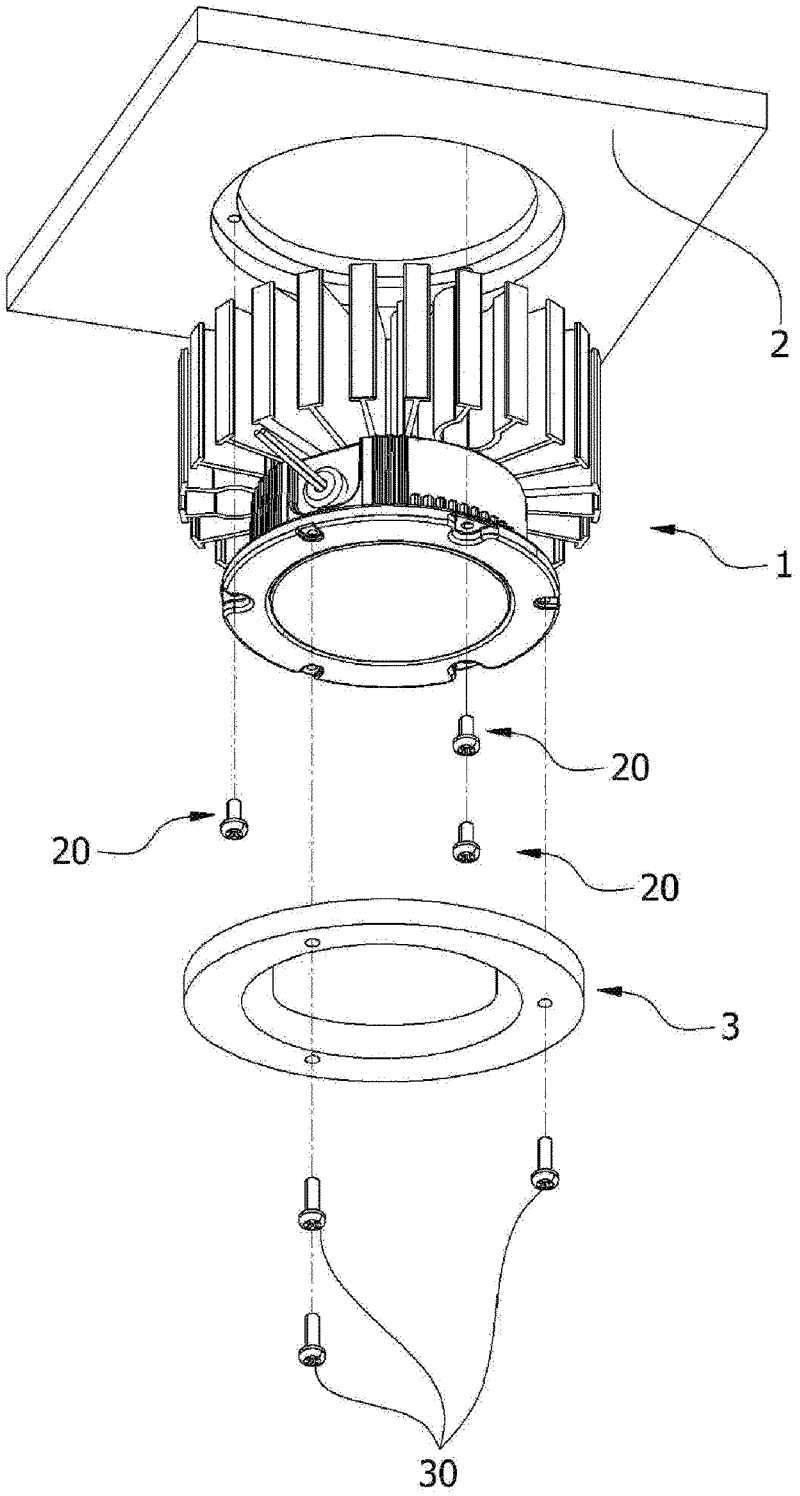
FIG. 1 is a view illustrating a coupling between a lighting device and a wall in accordance with an embodiment.

Referring to FIG. 1, a lighting device 1 in accordance with an embodiment may be installed in a ceiling surface 2 as a downlight. A downlight or embedded lamp may be a type of lighting in which a hole in a ceiling may be made and a light source may be embedded in the hole to architecturally integrate the lighting within a building. The downlight may be embedded in a ceiling and not exposed, which may allow a surface of the ceiling to appear neat. The downlight may allow the surface of the ceiling to be dark. The downlight may also be installed in a wall. As shown in FIG. 1, a trim 3 may be installed on the lighting device in order to appear neat and may not form a step between the lighting device 1 and the ceiling surface 2. That is, the trim 3 may be flush against the ceiling surface 2.

Figure 2:
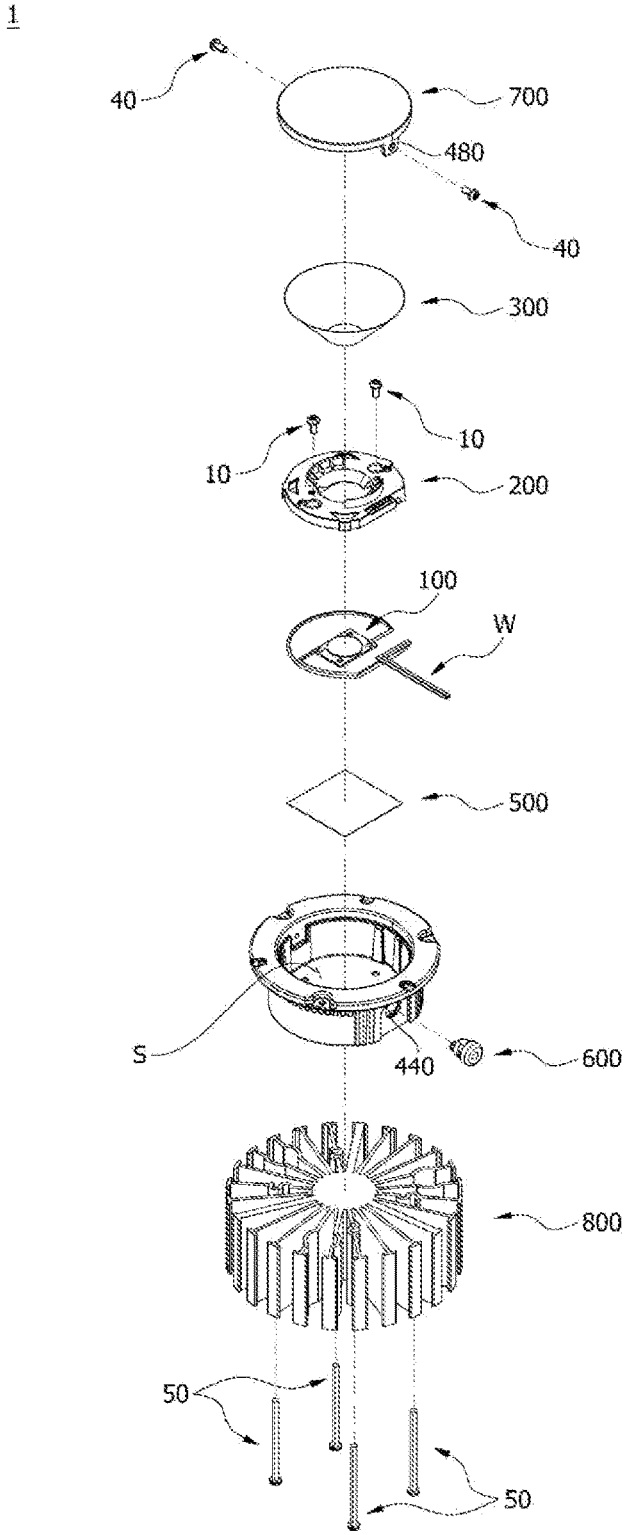
FIG. 2 is an exploded perspective view of the lighting device in accordance with an embodiment.
Figure 3:
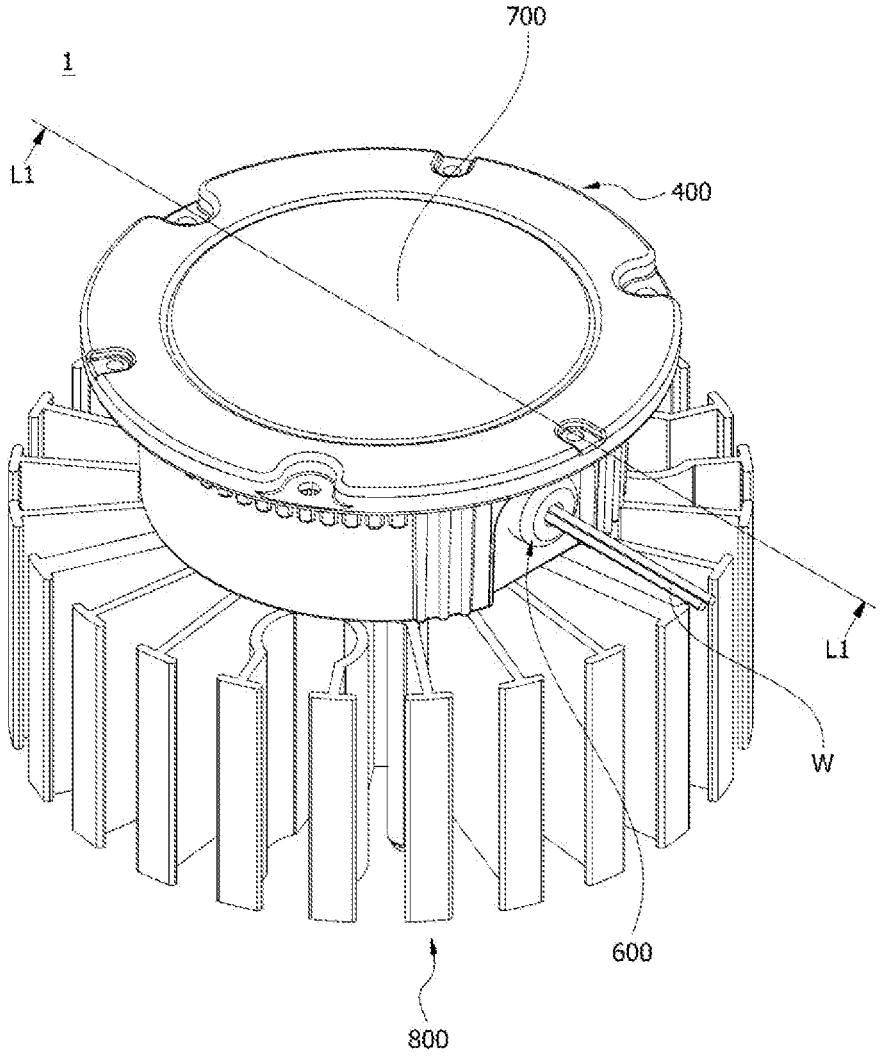
FIG. 3 is a coupled perspective view of the lighting device in accordance with an embodiment.
Figure 4:
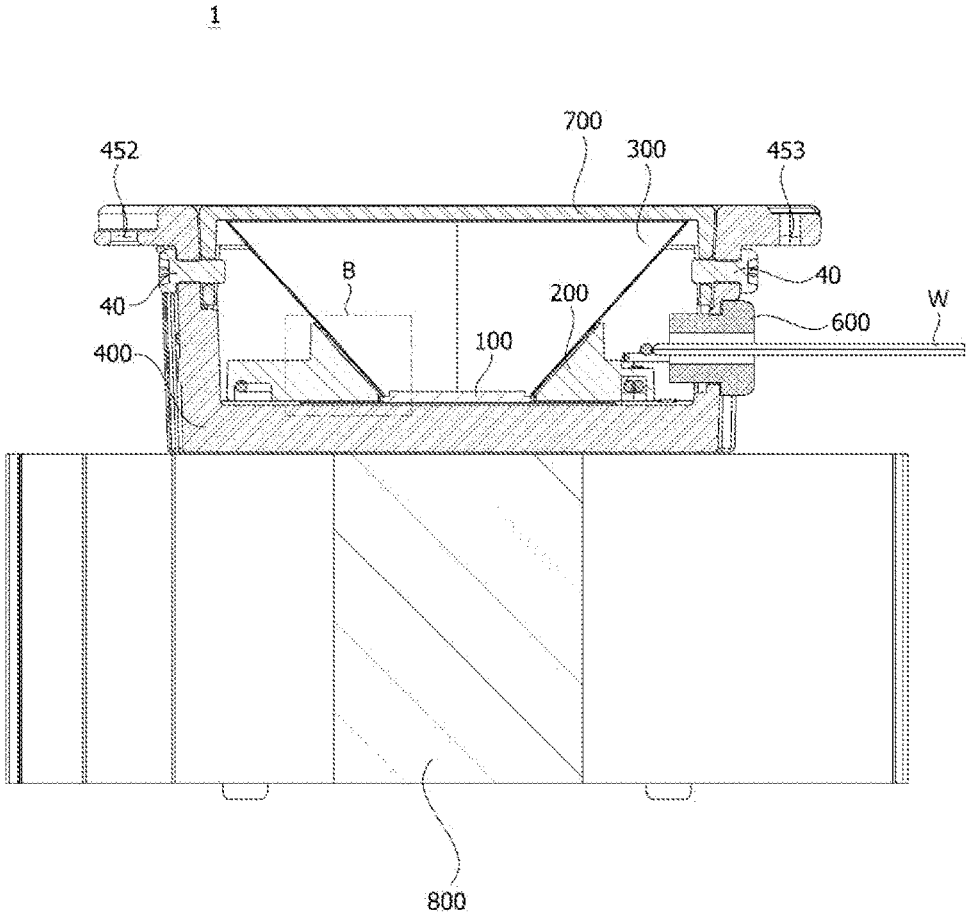
FIG. 4 is a cross-sectional view of the lighting device taken along a line L1-L1 of FIG. 3.

Referring to FIGS. 2 to 22, the lighting device 1 may include a light source module 100, a holder 200, a reflector 300, a housing 400, a thermal pad 500, a wire bushing 600, a cover, and a heat sink 800. The housing 400 may include an accommodation space S therein and an opening on one side to be connected to the accommodation space S. The light source module 100, the holder 200, the reflector 300, and the thermal pad 500 may be provided in the accommodation space S of the housing 400. The wire bushing 600, as shown in FIGS. 2 and 4, may be provided on the one side of the housing 400. As shown in FIGS. 2 and 3, the heat sink 800 may be installed on the housing 400 to be in contact therewith.

Figure 5:
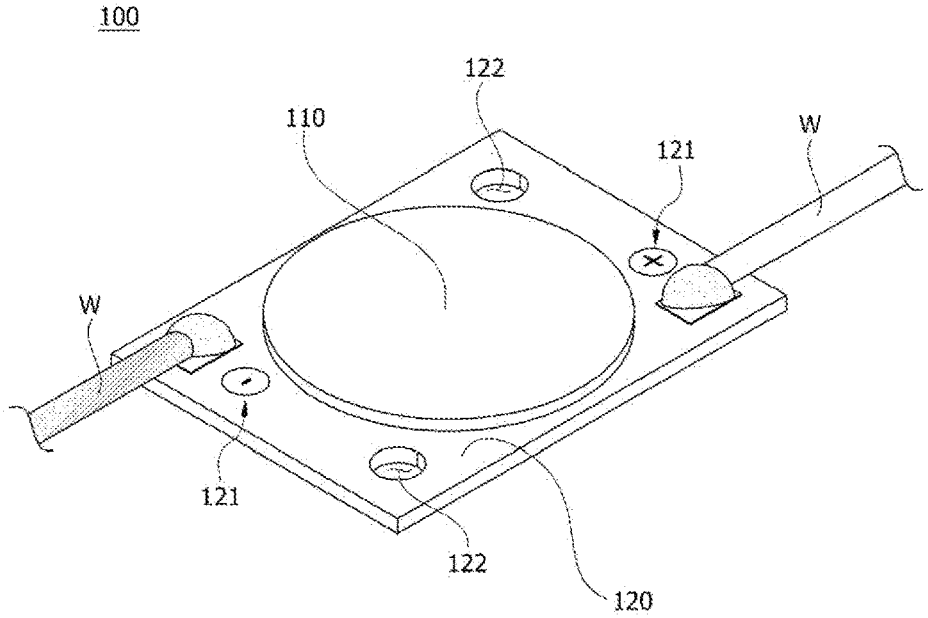
FIG. 5 is a view of a light source module of the lighting device in accordance with an embodiment.

Referring to FIG. 5, the light source module 100 may include a light source 110 and a substrate 120 on which the light source 110 may be provided. The light source module 100 may be a chips on board (COB) type, in which an unpackaged light emitting diode (LED) chip, such as, e.g., the light source 110, may be directly bonded to the substrate 120, and may be an LED package, in which the LED chip may be packaged. As shown in FIG. 5, wires W may be connected to the light source module 100 and may be symmetrical around a center of the light source module 100.

Power may be supplied through the wires W. To prevent power supplied through the wires W from being confused, marks 121 to distinguish positive and negative poles may be imprinted on the substrate 120. The wires W may differ in color to be distinguished. Accordingly, the marks 121 to distinguish the positive and negative poles and the colors of the wires W may match to prevent a user from being confused. The light source 110, the substrate 120, and the wires W may be electrically connected to one another.

The substrate 120, as shown in FIG. 5, may include a holder coupling hole 122 formed therein. The holder coupling hole 122 may be coupled with a coupling portion 290 having a protrusion shape included in the holder 200 to allow the light source module 100 to be provided in a preset position of the holder 200. The coupling hole 122, for example, may be formed in the substrate 120 but is not limited thereto. A protrusion may be formed on the substrate 120 and a hole with which the protrusion may be coupled may be formed in the holder 200.

Referring to FIGS. 6 to 10, the holder 200 may include a holder body 210, a hole 220, an inclined surface 230, a supporting portion 240, an outlet 250, a channel 260, and detachment preventing protrusions 270 and 270*a*. Also, due to a holder fastening member or fastener 10 shown in FIG. 2, the holder 200 may be fixed to the housing 400.

The holder 200 may be formed of a material such as plastic, polypropylene (PP), polyethylene (PE), polycarbonate (PC) having excellent heat resistance and impact strength. The holder body 210, as shown in FIGS. 6 and 7, may have a disc shape with a certain thickness, but is not limited thereto, and may have an oval or polygonal shape with a certain thickness.

The hole 220 may be formed in a center of the holder body 210 to allow light to emit from the light source module 100. That is, the hole 220 may allow light emitted from the light source 110 of the light source module 100 provided on the holder 200 to be exposed and may direct the light. The hole 220, as shown in FIG. 6, may be formed by the inclined surface 230, which may be inclined in a direction in which the light source module 100 may be installed on the holder body 210.

When the reflector 300 is provided on the holder 200, the inclined surface 230 may support the reflector 300. The holder body 210 may include a supporting portion 240 that extends and protrudes along the inclined surface 230. For example, to increase support for the reflector 300, the supporting portion 240 may be further formed on the holder body 210 in addition to the inclined surface 230 to support the reflector 300.

Figure 6:
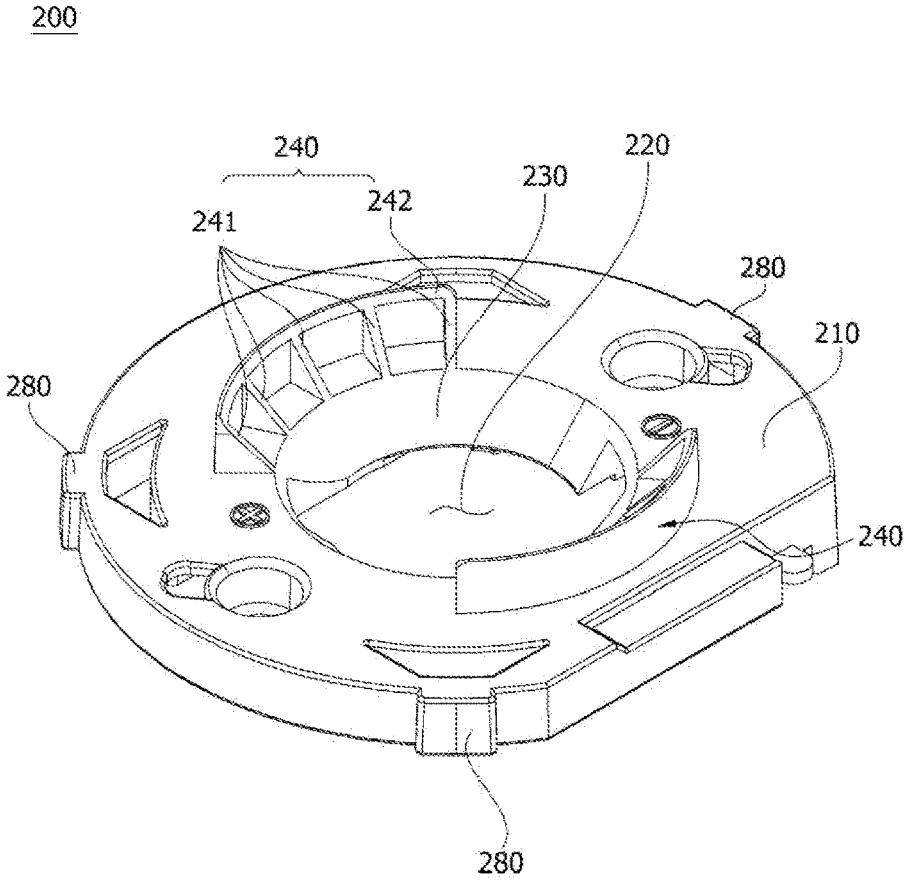
FIGS. 6 to 9 are views of a holder of the lighting device.
Figure 7:
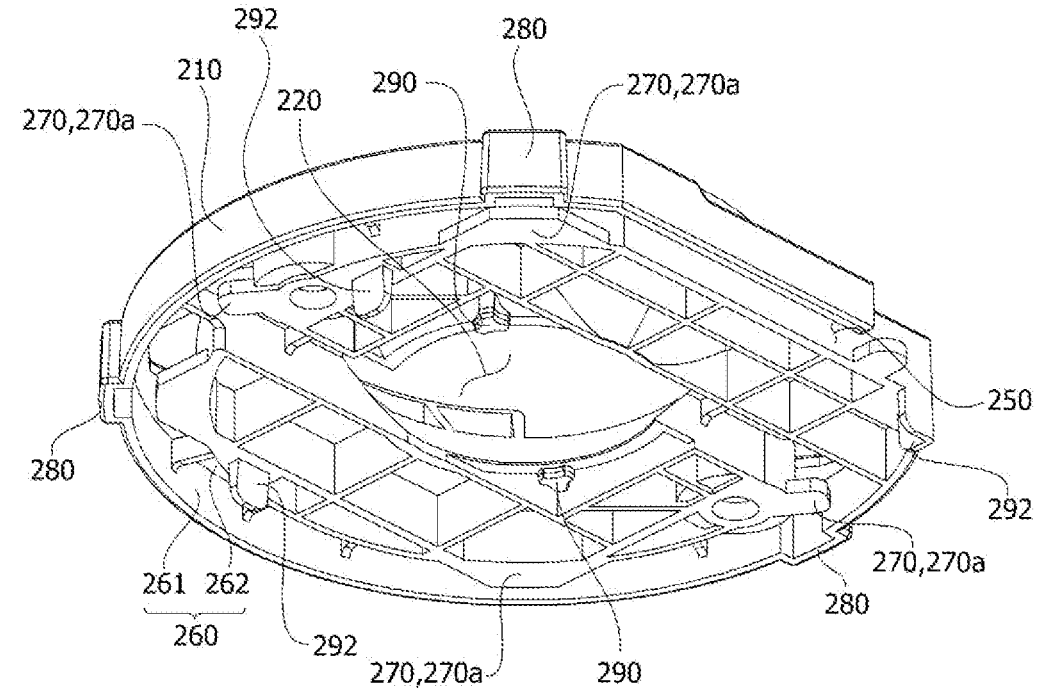
Figure 8:
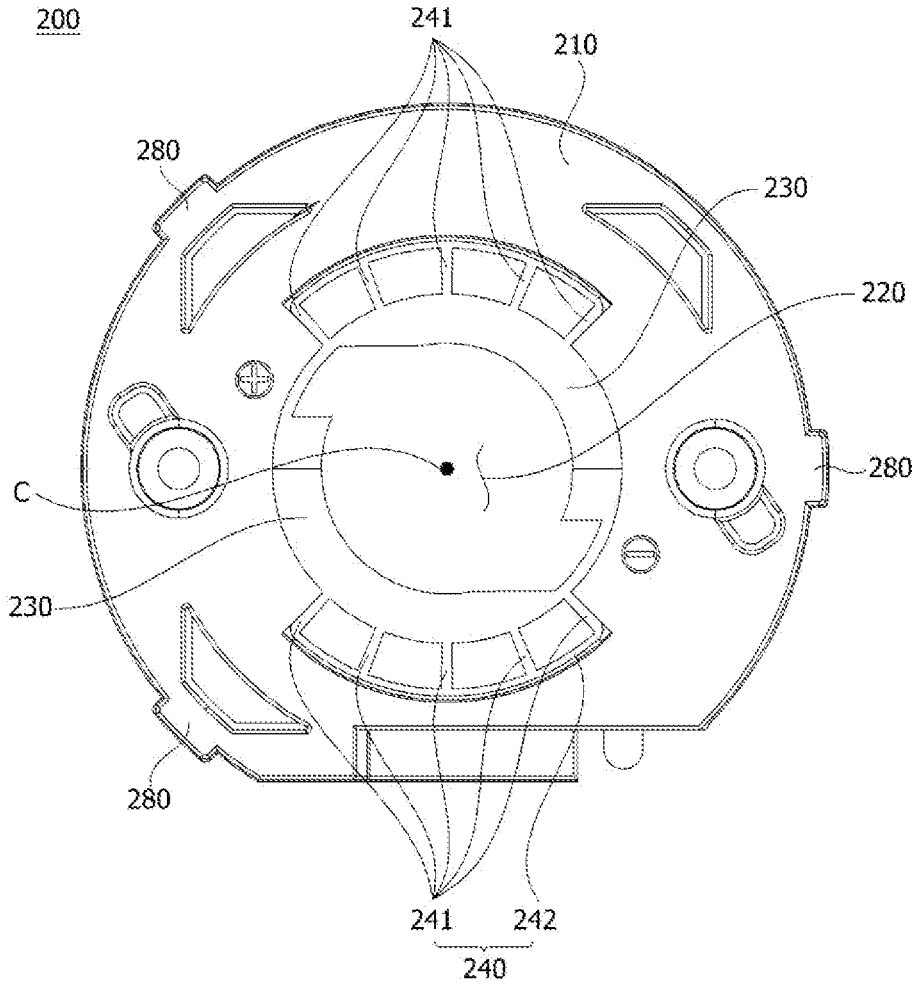

As shown in FIG. 6, the supporting portion 240 may include a plurality of incline frames 241 that support a side of the reflector 300 and a circumferential frame 242 to provide support for the incline frames 241. The supporting portions 240 may be symmetrical around a center C of the holder 200 to uniformly support the reflector 300, but are not limited thereto, and may be provided on only one side. Accordingly, the reflector 300 may be provided on the holder 200 to be supported by the inclined surface 230 and the supporting portions 240.

Figure 10:
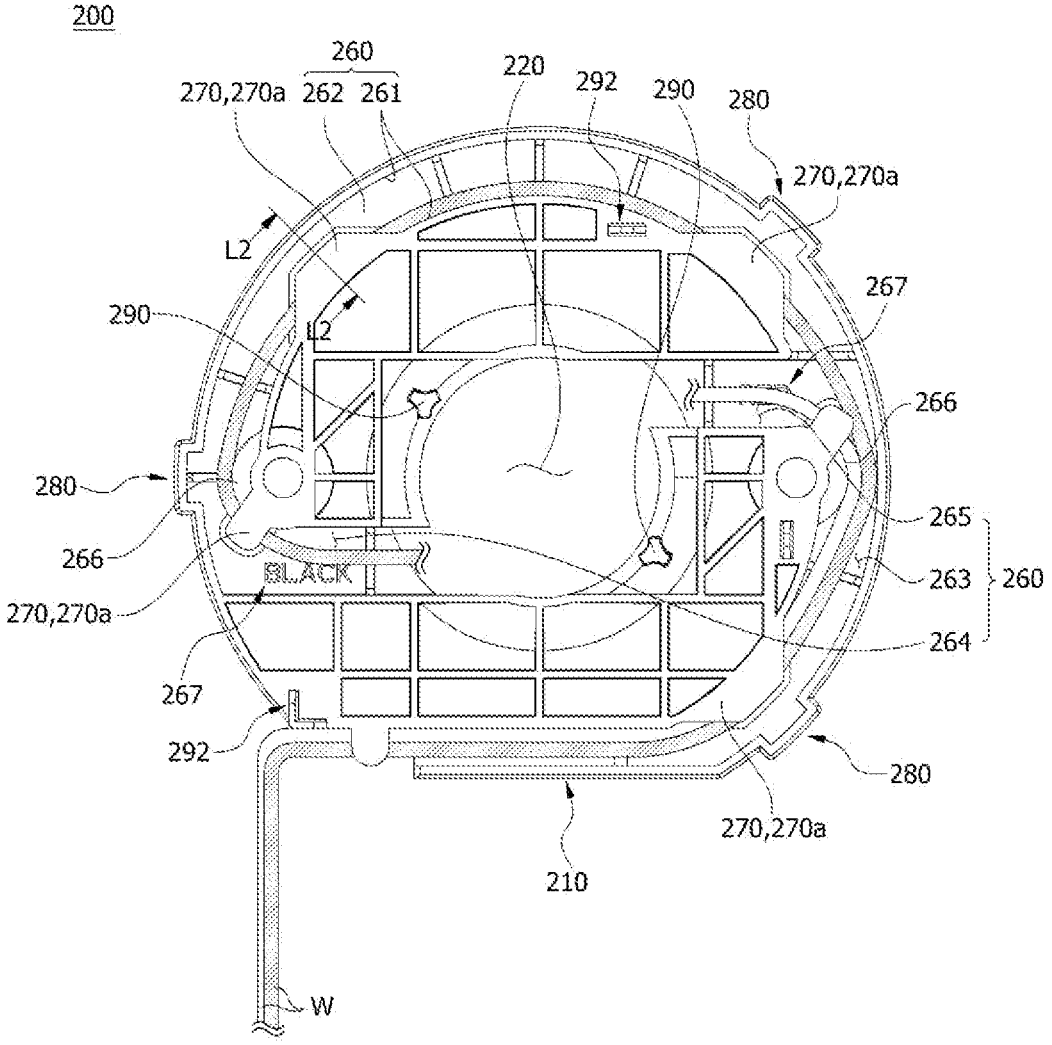
FIG. 10 is a view illustrating a coupling between the holder of the lighting device and a wire in accordance with an embodiment.

The outlet 250 may be formed in the holder body 210. As shown in FIG. 10, the two wires W connected to the light source module 100 provided in the center of the holder body 210 may be guided outside the holder 200 through the outlet 250. The channel 260 may be configured to allow the wires W connected to the light source module 100 to be guided to the outlet 250.

In the holder 200, based on the holder body 210, a direction in which the supporting portion 240 may be provided may be referred to as a top of the holder 200 and a direction opposite to the direction in which the supporting portion 240 may be provided may be referred to as a bottom. The channel 260 may be formed on the bottom of the holder 200 by considering a position of the wires W.

The channel 260 may be formed in a shape of a groove with an opening opposite a direction in which the light source module 100 may be installed. That is, the channel 260 may be formed in the groove shape on the bottom of the holder 200 to connect the hole 220 with the outlet 250. Accordingly, the channel 260 may be formed by two sides 261 and one horizontal plane 262.

Figure 9:
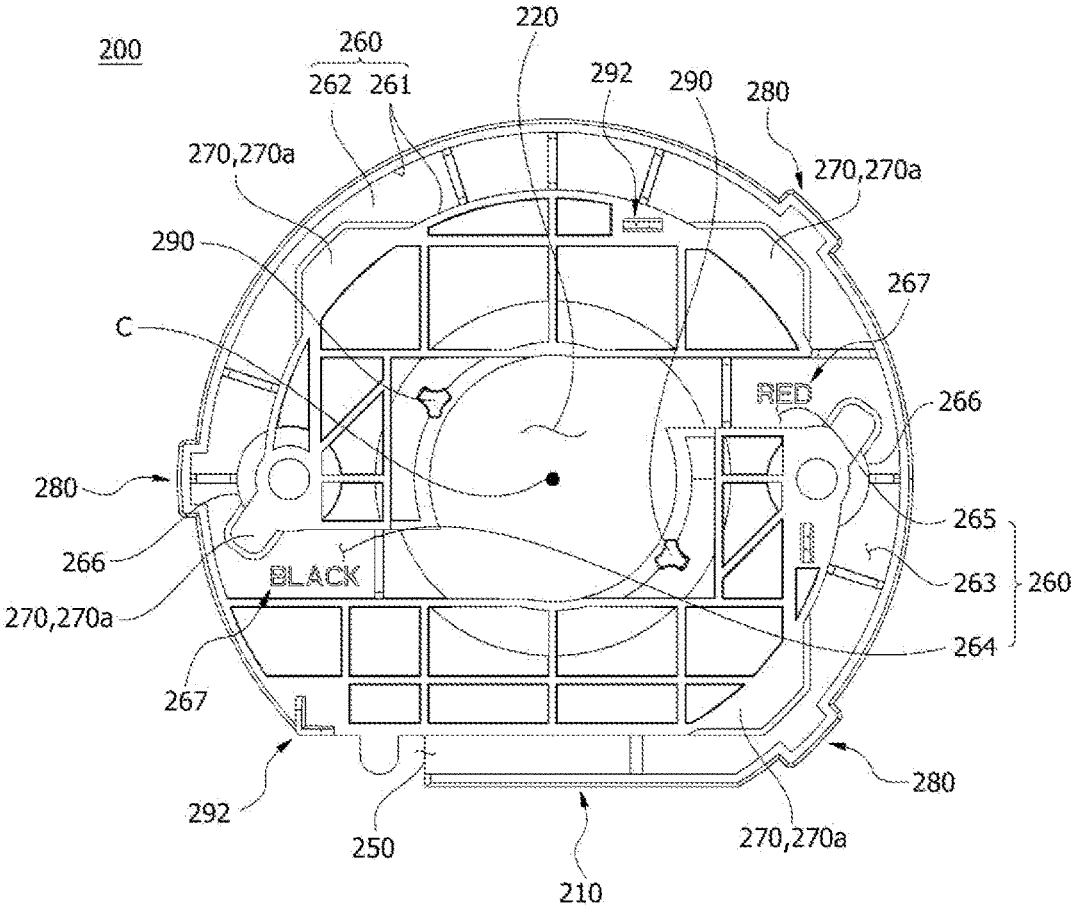

Referring to FIG. 9, the channel 260 may be divided into three areas. The channel 260 may include a first channel 263 formed in a circumferential direction and having a side connected to the outlet 250, a second channel 264 formed to guide one of the wires W to the first channel 263, and a third channel 265 formed to guide another one of the wires W to the first channel 263.

The first channel 263, as shown in FIGS. 9 and 10, may be formed in the circumferential direction along an edge of the holder body 210. Accordingly, the first channel 263, which may be formed with a certain curvature along the circumferential direction along the edge, may allow the wire W to not be bent or uneven. For example, the channel 260 may be configured to linearly connect the hole 220 with the outlet 250 to expose the wire W outside the holder 200. However, the outlet 250 may need to be formed according to a number of the wires W. Accordingly, productivity may be reduced due to an additional process of forming outlets. Also, since at least two outlets 250 may be formed, it may be difficult to arrange the wires W.

The second channel 264 and the third channel 265 may be configured to connect the hole 220 with the first channel 263, respectively. Corners 266, at which the first channel 263 meets the second channel 264 and the first channel 263 meets the third channel 265, may be rounded. Thus, the wires W may not be damaged due to the corners 266 when the wires W are strained. As shown in FIG. 9, marks 267, such as, for example, lettering, may be imprinted on the horizontal plane 262 of the channel 260 to prevent connection with the wires W from being confused.

A plurality of such detachment preventing protrusions 270 and 270*a* may be provided along the channel 260. The detachment preventing protrusions 270 and 270*a* may be formed to protrude from the opening of the channel 260. Accordingly, the detachment preventing protrusions 270 and 270*a*, as shown in FIGS. 10 and 11, may prevent the wires W from being detached through the opening.

Figure 11A:
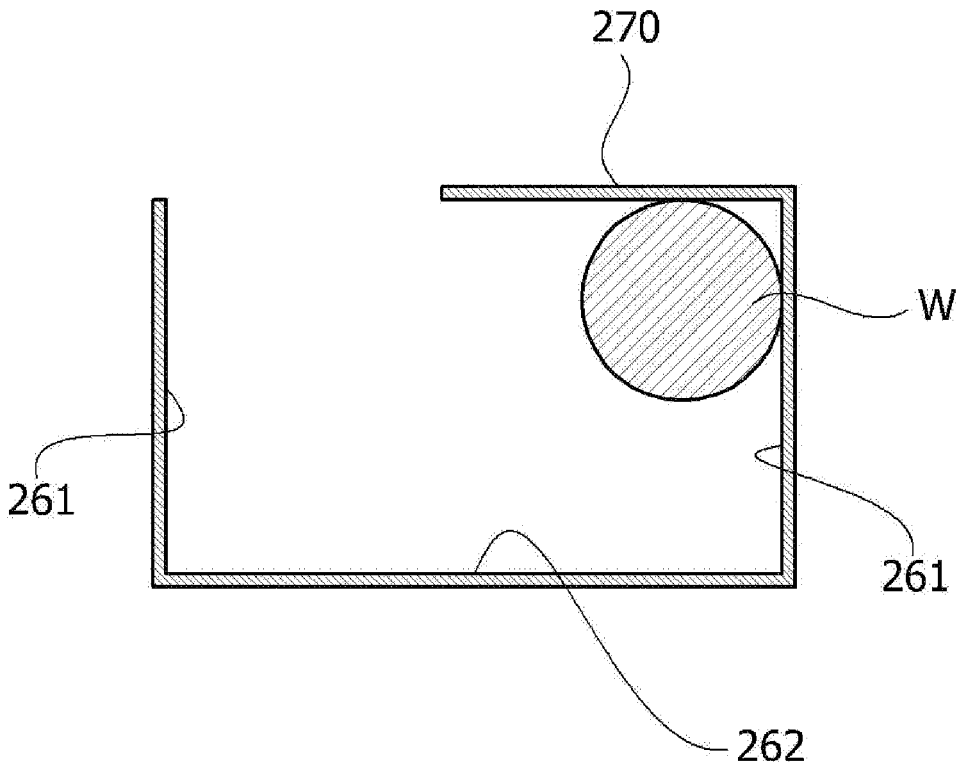
FIGS. 11A to 11C are cross-sectional views of the coupling in FIG. 10 taken along a line L2-L2 of FIG. 10.
Figure 11B:
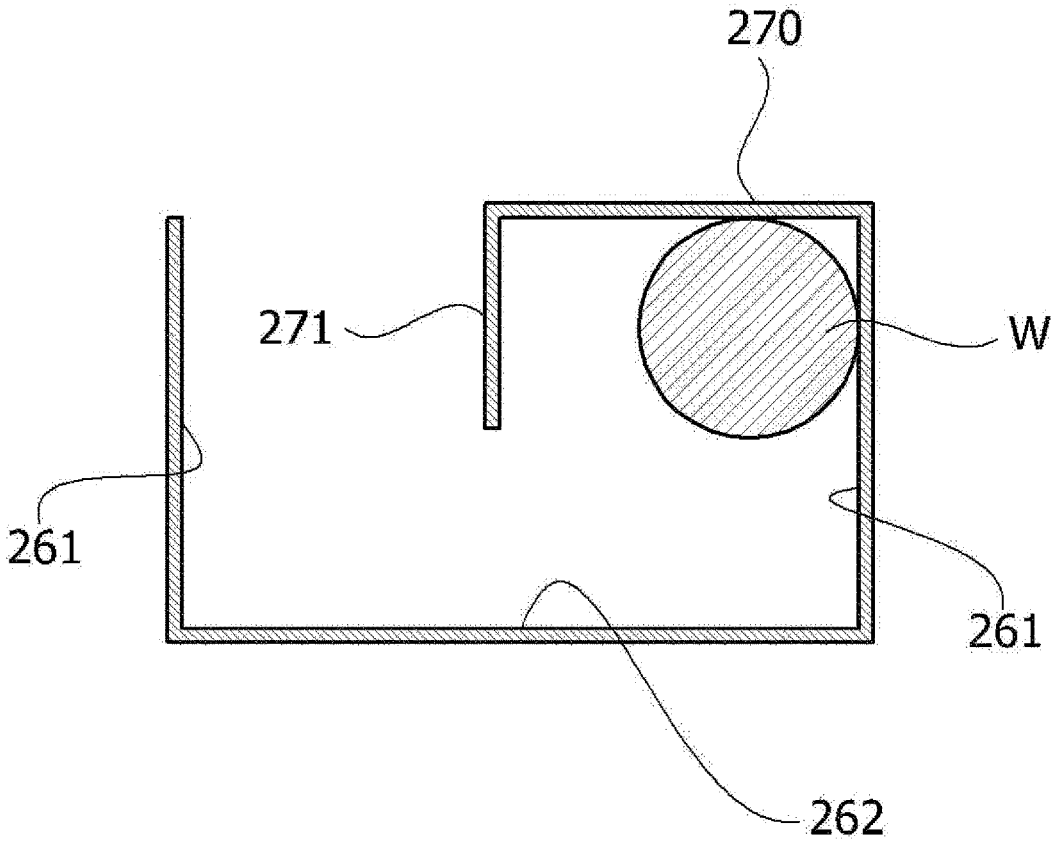
Figure 11C:
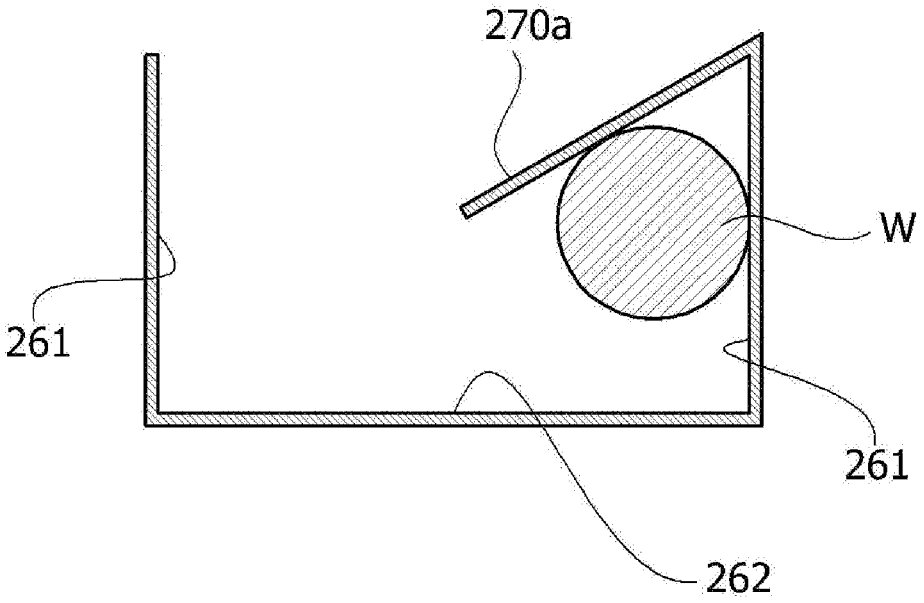
Figure 12:
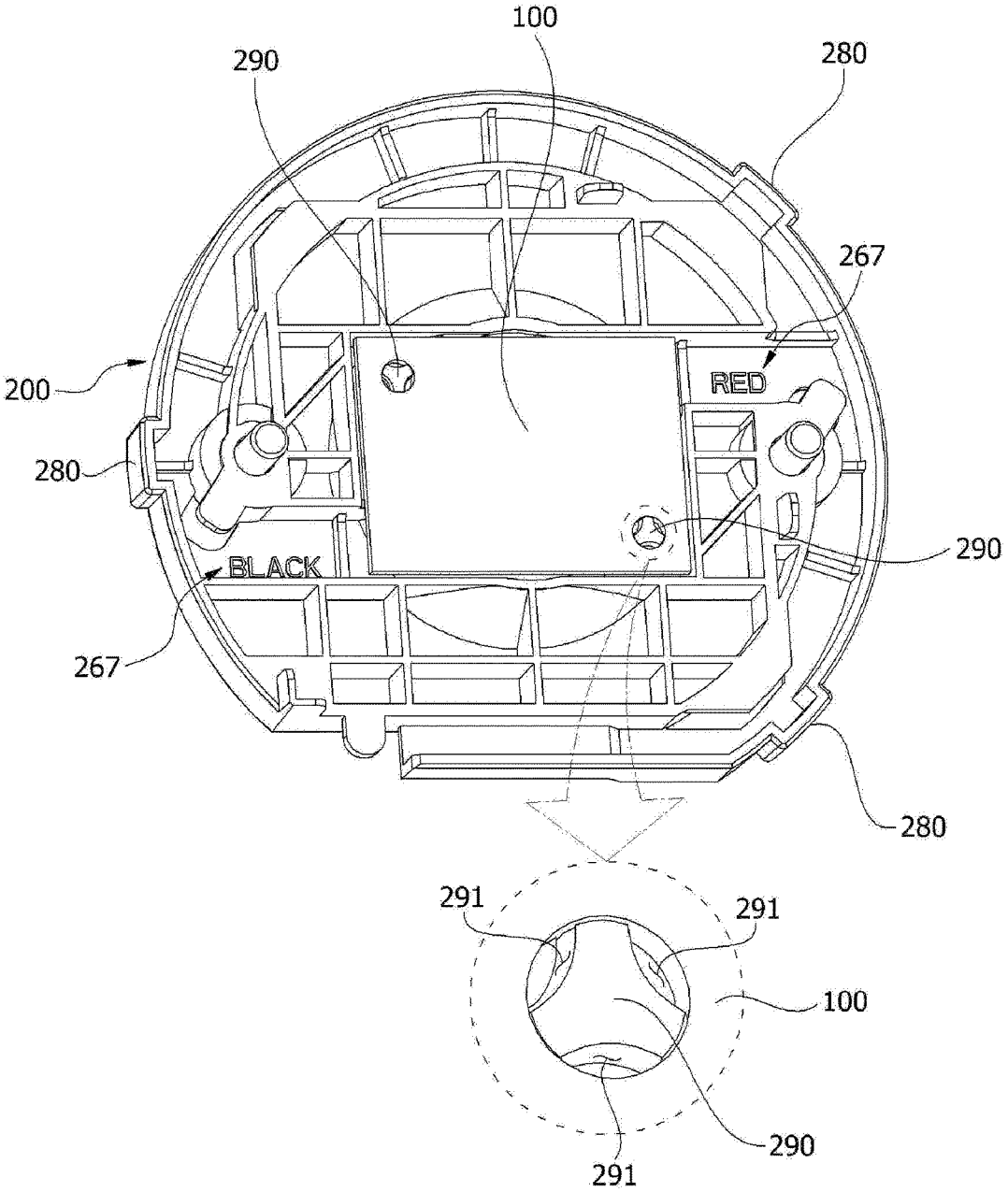
FIG. 12 is a view illustrating a coupling between the holder and the light source module of the lighting device in accordance with an embodiment.

The detachment preventing protrusion 270, as shown in FIG. 11A, may be formed parallel to the horizontal plane 262 of the channel 260 to prevent the wire W from being detached through the opening of the channel 260. As shown in FIG. 11B, a protrusion 271 may be further formed on an end of the detachment preventing protrusion 270 to protrude toward the horizontal plane 262. As shown in FIG. 11C, the detachment preventing protrusion 270*a* may be inclined toward the horizontal plane 262 to prevent the wire W from being detached through the opening.

Since the detachment preventing protrusion 270*a* is inclined toward to the horizontal plane 262, it may be easy for the user to provide or remove the wire W as needed. Also, when the lighting device 1 is installed in the ceiling surface 2, the detachment preventing protrusions 270*a* prevent the wires W from being detached through the opening of the channel 260 due to gravity.

The holder 200 may further include a guide protrusion 280 formed on the side of the holder body 210. The guide protrusion 280 may be guided by a guide portion 430 of the housing 400 to provide the holder 200 in a preset position of the housing 400. The holder 200, as shown in FIG. 9, may further include the coupling portion 290 assembled with the holder coupling hole 122.

The coupling portion 290 may be assembled with the holder coupling hole 122 to allow the light source module 100 to be provided in a preset position of the holder 200. Also, the coupling portion 290 assembled with the holder coupling hole 122 may prevent the light source module 100 from moving in a horizontal direction. The holder coupling hole 122 and the coupling portion 290 may be coupled via fitting.

The coupling portion 290 may include an incised groove 291 that may be curved based on an axial center in a longitudinal direction of the coupling portion 290. The incised groove 291 may be formed at an end or circumference of the coupling portion 290. Accordingly, when the light source module 100 is disassembled from the holder 200, the user may easily disassemble the light source module 100 through the incised groove 291 using a tool.

Figure 13:
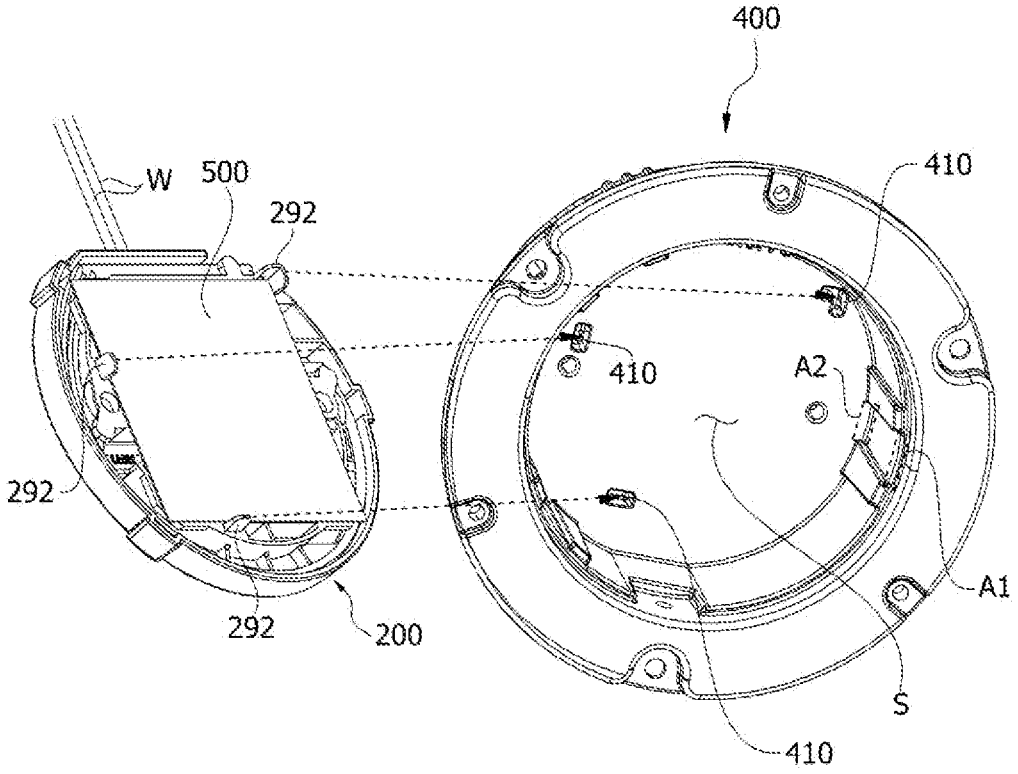
FIG. 13 is a view illustrating a coupling among the holder, a thermal pad, and a housing of the lighting device in accordance with an embodiment.

The holder 200, as shown in FIG. 13, may further include a guide rib 292 provided to provide the thermal pad 500 in a preset position of the holder 200. The guide rib 292 may be formed to protrude from a bottom of the holder body 210. The guide rib 292 may be coupled with a guide rib coupling groove 410 formed in the housing 400. Accordingly, the guide rib 292 may guide the holder 200 to be provided in the preset position of the housing 400 together with the guide protrusion 280. That is, the guide rib 292 may provide a placement of the thermal pad 500 and may guide the holder 200 to be installed in the preset position of the housing 400.

Figure 14:
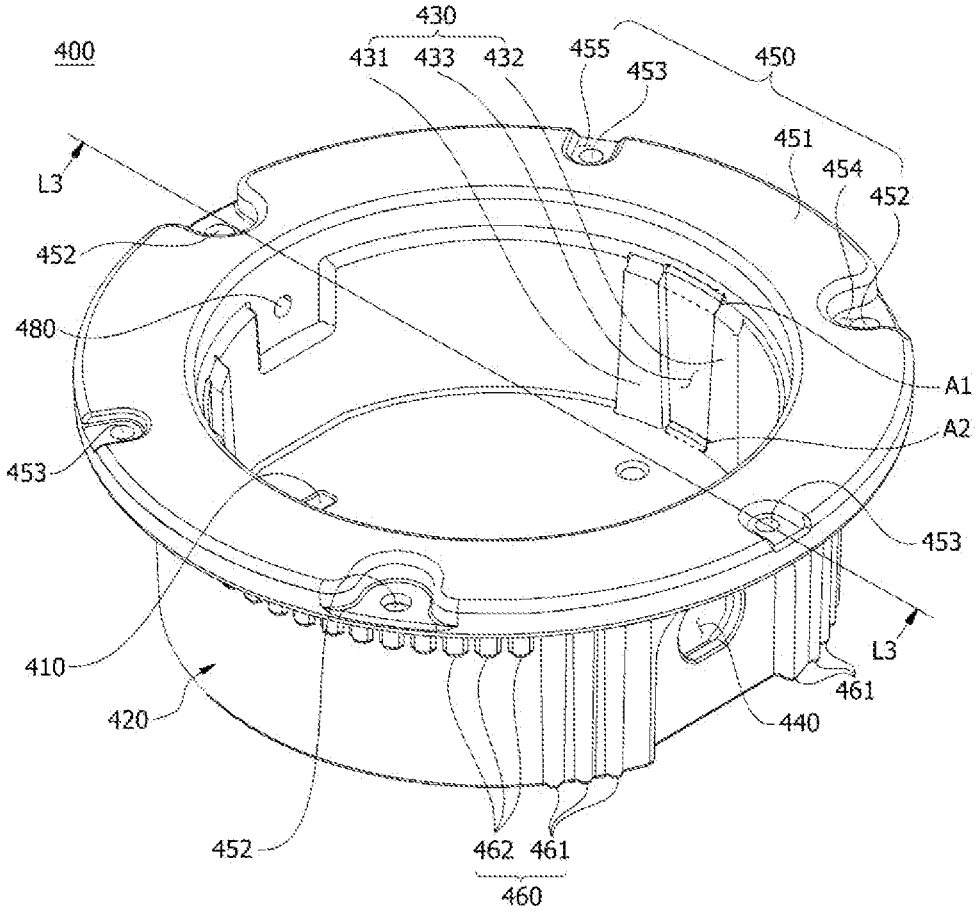
FIGS. 14 to 17 are a perspective view, a top view, a left side view, and a right side view, respectively, of the housing of the lighting device in accordance with an embodiment.
Figure 15:
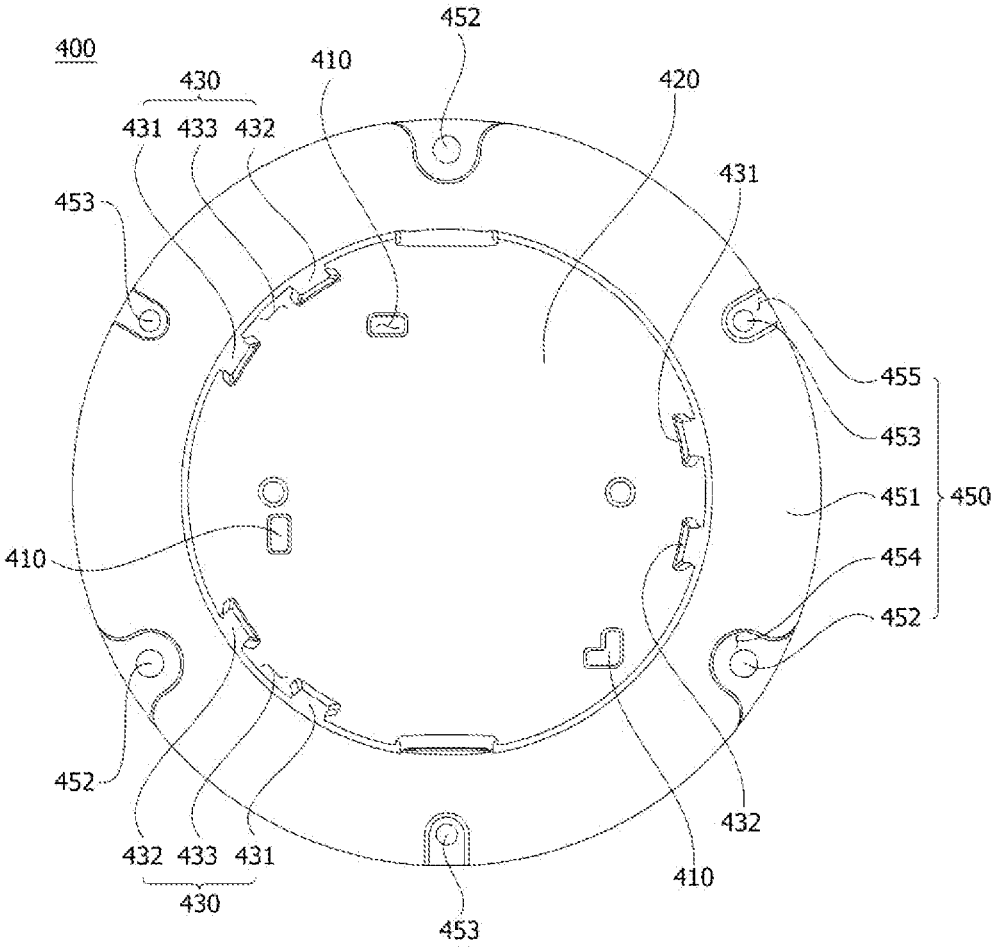

Referring to FIGS. 14 to 19, the housing 400 may include a housing body 420 which may include the guide rib coupling groove 410, the guide portion 430, a wire bushing coupling hole 440, a flange portion 450, and a serration 460. The housing body 420 may have the accommodation space S therein for the holder 200, the reflector 300, and the thermal pad 500. The housing body 420, for example, may be formed in a cylindrical shape as shown in FIG. 14, but is not limited thereto, and may be formed in various shapes such as a triangular prism, square prism, etc.

Figure 18:
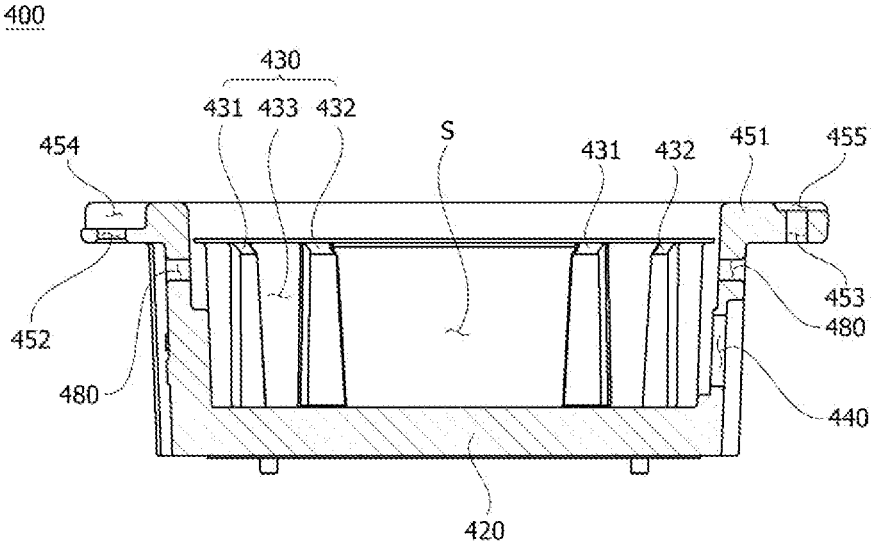
FIG. 18 is a cross-sectional view of the housing in FIG. 14 taken along a line L3-L3 of FIG. 14.

Referring to FIGS. 14 and 18, the guide portion 430 may be provided on an inner surface of the housing body 420. The guide portion 430 may include a first guide member or guide 431 and a second guide member or guide 432. The first guide member 431 and the second guide member 432 may be formed to protrude from the inner surface of the housing body 420, respectively. The first guide member 431 and the second guide member 432, as shown in FIG. 18, may be formed lengthwise from a bottom edge to a top edge of the housing body 420, respectively. The guide protrusion 280 may be guided through a coupling space formed between the first guide member 431 and the second guide member 432.

The coupling space 433 may have a shape with a broad top and a narrow bottom when viewed from a center of the housing body 420 toward the inner surface thereof. Accordingly, a space A1 on an upper portion of the housing body 420 may be broader than a space A2 on a lower portion thereof. The space A2 on the lower portion may have a same width as a width of the guide protrusion 280. For example, a width of the coupling space 433 formed on the lower portion of the housing body 420 may be identical to the width of the guide protrusion 280. Accordingly, the guide protrusion 280 may be guided by the guide portion 430 and may be coupled with the space A2 on the lower portion via fitting. The space A2 on the lower portion may be narrower than the space A1 on the upper portion and slightly broader than the width of the guide protrusion 280, but is not limited thereto.

Figure 16:
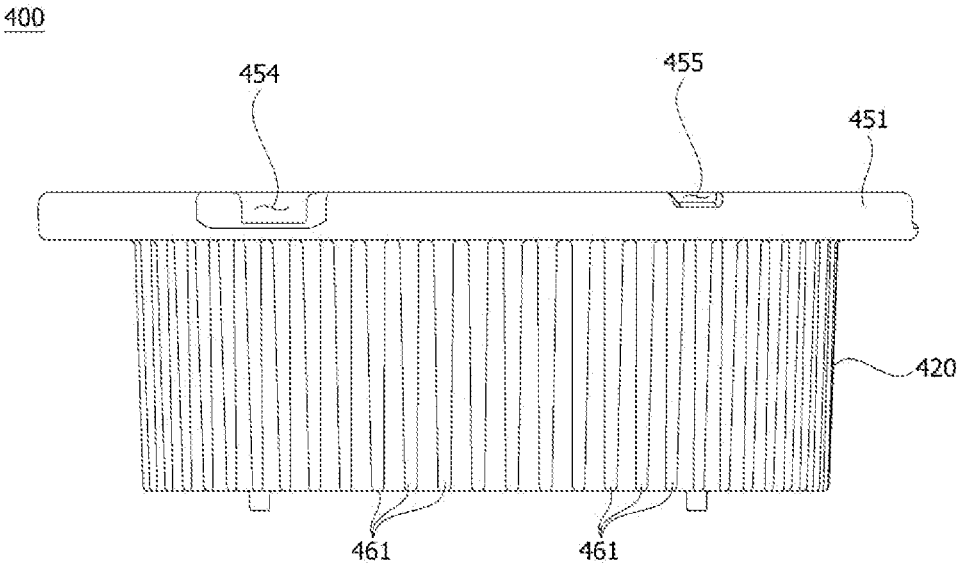

The wire bushing coupling hole 440, as shown in FIG. 14, may be formed in the side of the housing body 420 and may be coupled with the wire bushing 600. The flange portion 450, as shown in FIGS. 14 and 16, may be formed to protrude outside from an end of an opening of the housing body 420. For example, the flange portion 450 may be formed in a shape of a flange to be coupled with the trim 3. The housing body 420 and the flange portion 450 may be integrally formed to emit internal heat through thermal conduction. Also, the housing body 420 and the flange portion 450 may be formed of a material that provides rigidity and excellent thermal conductivity. For example, the housing body 420 and the flange portion 450 may be formed of a metal material, such as an aluminum alloy, but is not limited thereto.

The flange portion 450 may include a flange body 451 having a certain thickness, a mounting hole 452, and a trim hole 453. The flange body 451, as shown in FIG. 14, may be formed in an annular shape, but is not limited thereto. The mounting hole 452 and the trim hole 453 may penetrate the flange body 451, respectively.

As shown in FIG. 1, a first fastening member 20 may penetrate or pass through the mounting hole 452 and may be coupled with the ceiling surface 2. Accordingly, the lighting device 1 may be fixed to the ceiling surface 2. The first fastening member 20 may be a bolt or a screw, which has a head As shown in FIG. 14, a mounting step groove 454 may be further formed around the mounting hole 452. The mounting step groove 454 may be a groove concavely formed on a top surface of the flange body 451, and the mounting hole 452 may be formed in an area of the mounting step groove 454. Accordingly, when the mounting hole 452 is fastened to the first fastening member 20, a head of the fastening member 20 may be located on the mounting step groove 454 and may not interrupt or get in the way of coupling with the trim 3.

As shown in FIG. 1, a second fastening member 30 may penetrate or pass through the trim 3 and may be coupled with the trim hole 453. As shown in FIG. 14, a trim step groove 455 may be further formed around the trim hole 453. The trim step groove 455 may be a groove concavely formed on the top surface of the flange body 451, and the trim hole 453 may be formed in an area of the trim step groove 455. Accordingly, when the second fastening member 30 is fastened to the trim hole 453, the trim step groove 455 may strongly bind the second fastening member 30 with the trim 3. That is, due to the trim step groove 455, a space may be formed between the trim 3 and the flange body 451. When the second fastening member 30 is fastened to the trim hole 453, the trim 3 and the flange body 451 may be pressurized by the second fastening member 30 to have stronger binding force due to the space.

The serration 460 may be formed an outer surface of the housing body 420. For example, the serration 460 may be formed an outer circumferential surface of the housing body 420. The serration 460 may increase heat sinking effects by increasing a surface area of the housing body 420. Accordingly, the serration 460 may be formed of a metal material similar to the housing body 420. The serration 460 may be integrally formed with the housing body 420, but is not limited thereto, and may be added to and provided on the housing body 420.

The serration 460 may include a plurality of first serrations 461 and a plurality of second serrations 462. The plurality of first serrations 461 may protrude lengthwise from the bottom edge to the top edge of the housing body 420. The plurality of second serrations 462 may protrude a certain length from the top edge or the bottom edge of the housing body 420. The respective first serrations 461 may be spaced apart at certain intervals. The respective second serrations 462 may be spaced apart at certain intervals.

The serration 460 may be formed at least one side of the outer circumferential surface of the housing body 420. For example, only the plurality of first serrations 461 may be formed or only the plurality of second serrations 462 may be formed, and the plurality of first serrations 461 and the plurality of second serrations 462 may be alternatively formed, but embodiments are not limited thereto.

Figure 17:
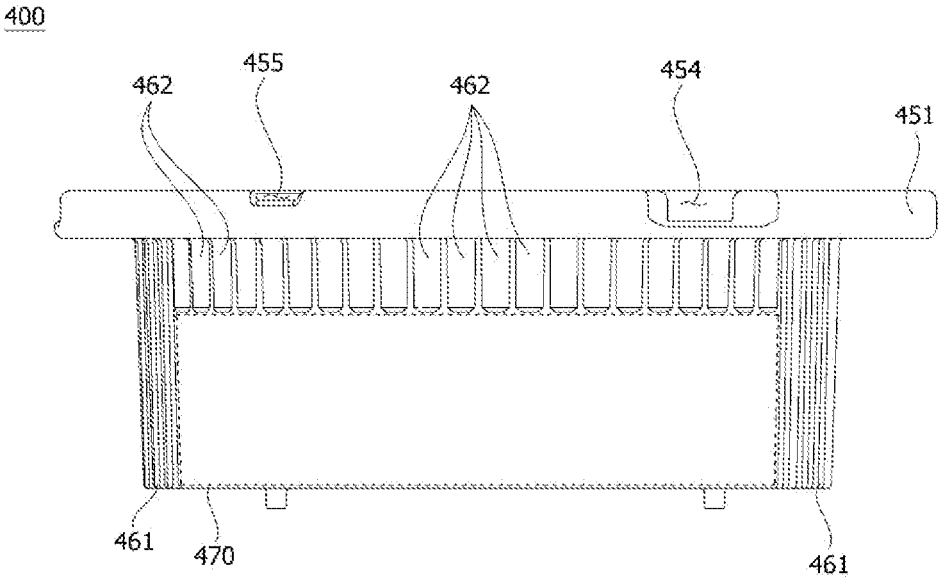

As shown in FIG. 17, due to the plurality of second serrations 462 formed on the outer circumferential surface of the housing body 420, a certain label-attachment area 470, in which the second serrations 462 may not be formed, may be formed on the outer surface of the housing body 420. A label filled in with information, such as, e.g., performance, manufacturing country, and product serial number, may be attached to the label-attachment area 470.

The housing 400 may include a cover coupling hole 480 configured to fix or couple a cover 700 to the housing 400. As shown in FIG. 2, a third fastening member or fastener 40 may penetrate the cover coupling hole 480 and may be coupled with a side of the cover 700.

Figure 19:
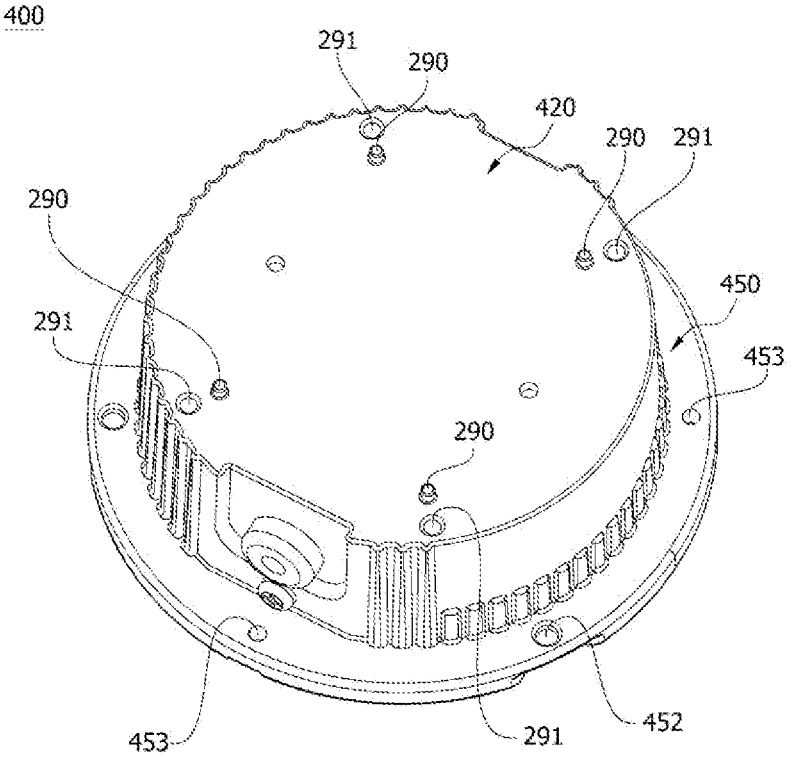
FIG. 19 is a bottom perspective view of the housing of the lighting device in accordance with an embodiment.
Figure 25:
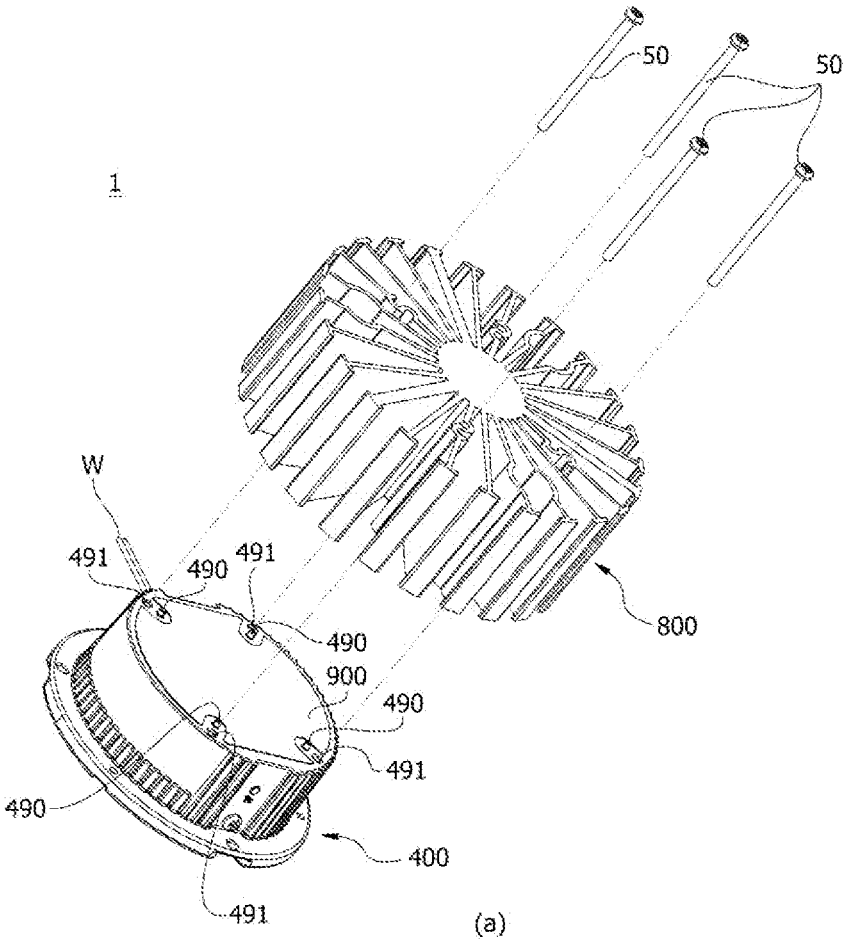
FIGS. 25 and 26 are views illustrating a coupling between the heat sink and the housing of the lighting device in accordance with an embodiment.
Figure 25:
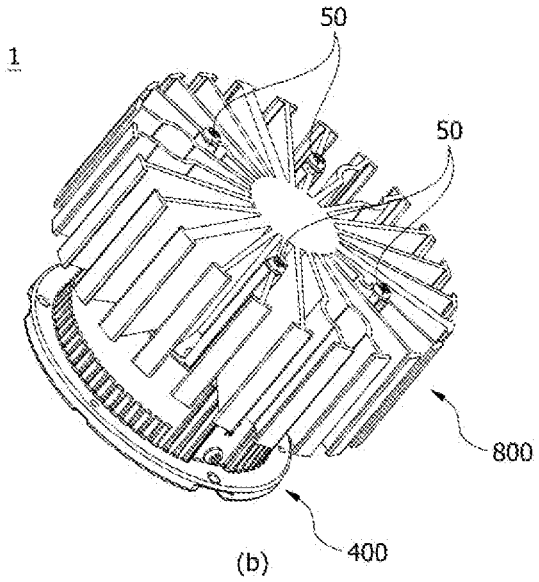

Referring to FIGS. 19 and 25, the housing 400 may include a heat sink guide member 490 and a heat sink fastening groove 491 formed on a bottom surface thereof. The heat sink guide member 490 may guide the heat sink 800 to be provided in a preset position of the housing 400. As shown in FIG. 25, the heat sink 800 guided by the heat sink guide member 490 may be fixed to the housing 400 by a fourth fastening member or fastener 50. An end of the fourth fastening member 50 may be fastened to the heat sink fastening groove 491 to fix the heat sink 800 to the housing 400. The fourth fastening member 50 may be a bolt or a screw, but is not limited thereto.

The thermal pad 500, as shown in FIG. 13, may be provided between the holder 200 and the housing 400 to cover a surface of the light source module 100 and transfer heat generated by the light source module 100 to the housing 400. The thermal pad 500 may be formed with a larger area than an area of the light source module 100, but is not limited thereto.

Figure 20:
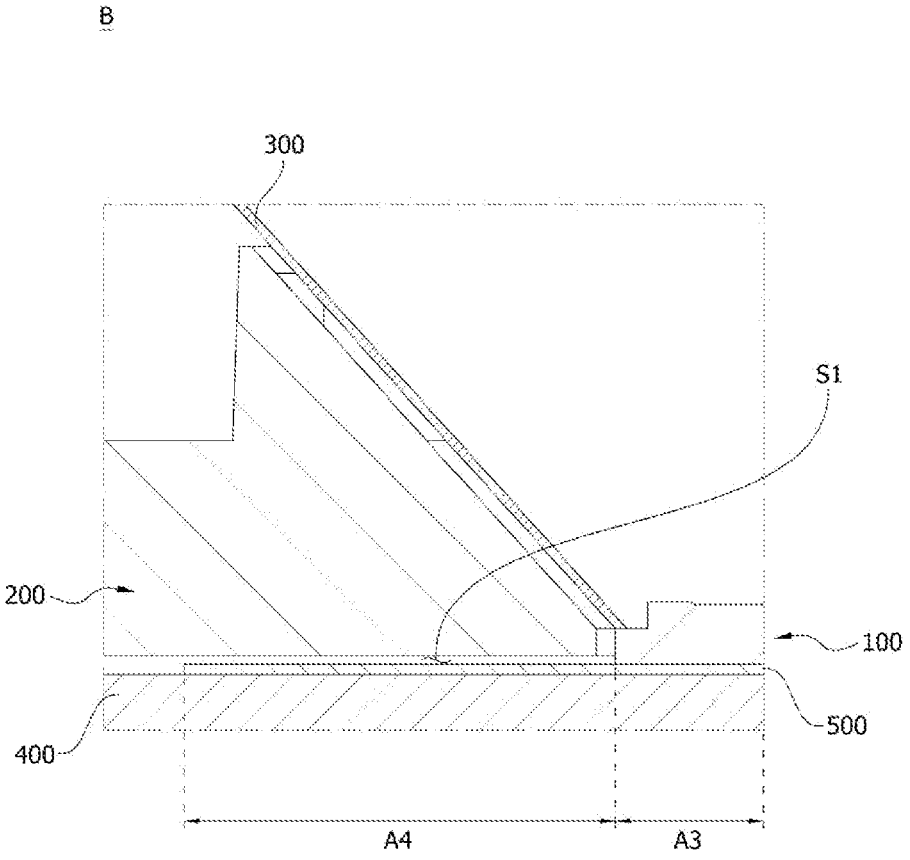
FIG. 20 is a view illustrating an area B of FIG. 4.

Referring to FIG. 20, the thermal pad 500 may be divided into a contact area A3 to be in contact with the surface of the light source module 100 and a noncontact area A4 not in contact with the surface of the light source module 100. When the thermal pad 500 is provided on the holder 200 on which the light source module 100 may be provided, the noncontact area A4 may be spaced apart from the holder 200.

The noncontact area A4 of the thermal pad 500 may be spaced apart from the holder 200, thereby forming a separation space S1. The heat generated by the light source module 100 and transferred to the thermal pad 500 may be emitted outside through the separation space S1. Accordingly, the separation space S1 may increase heat sinking performance on heat transferred through the thermal pad 500.

Figure 21:
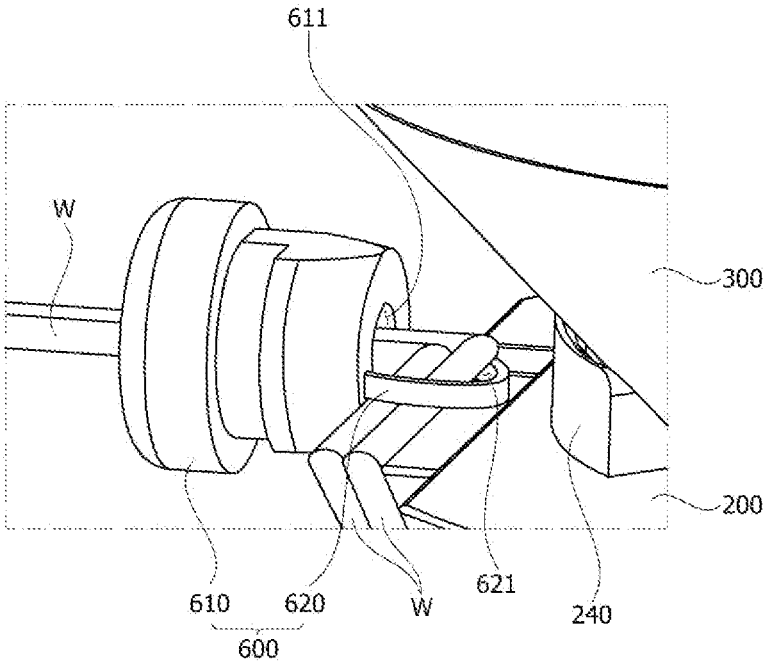
FIG. 21 is a view of a wire bushing of the lighting device in accordance with an embodiment.
Figure 22:
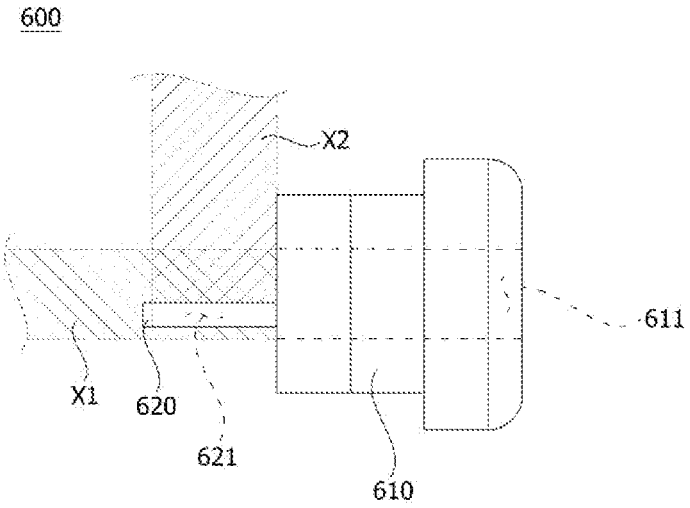
FIG. 22 is a view illustrating an arrangement between the wire bushing and the wire of the lighting device in accordance with an embodiment.

The wire bushing 600 may guide the wires W exposed from the outlet 250 of the holder 200 to an outside of the housing 400. Referring to FIGS. 21 and 22, the wire bushing 600 may include a wire bushing body 610 and a wire guide member or guide 620. The wire bushing body 610 may include a wire through hole 611 configured to allow the wires W to pass therethrough. The wire through hole 611 may be formed in the wire bushing body 610 in an insertion direction of the wire bushing body 610.

The wire guide member 620 may protrude from an end of the wire bushing body 610 in the insertion direction of the wire bushing body 610. Also, a wire guide hole 621 may be formed inside the wire guide member 620. As shown in FIG. 21, the wires W exposed form the outlet 250 may pass through the wire guide hole 621 and the wire through hole 611.

When the wire W is installed through the wire bushing 600, the wire W exposed from the outlet 250 may be exposed outside the housing 400 through the wire bushing coupling hole 440 and then may pass through the wire guide hole 621 and the wire through hole 611. Also, the wire bushing 600 may be coupled with the wire bushing coupling hole 440. Accordingly, even though the housing 400 is coupled with the wire bushing 600, the wire W may be prevented from being pushed out by the wire bushing 600 and from being uneven.

As shown in FIG. 22, the wire through hole 611 and the wire guide hole 621 may be arranged to allow a virtual area X1 that extends from the wire through hole 611 and a virtual area X2 that extends from the wire guide hole 621 to intersect with each other. Accordingly, when the wire W is installed in the wire bushing 600, the wire W may pass through an area where the area X1 and the area X2 intersect with each other, thereby preventing the wire W from being pushed out by the wire bushing 600 and from being uneven.

Figure 23:
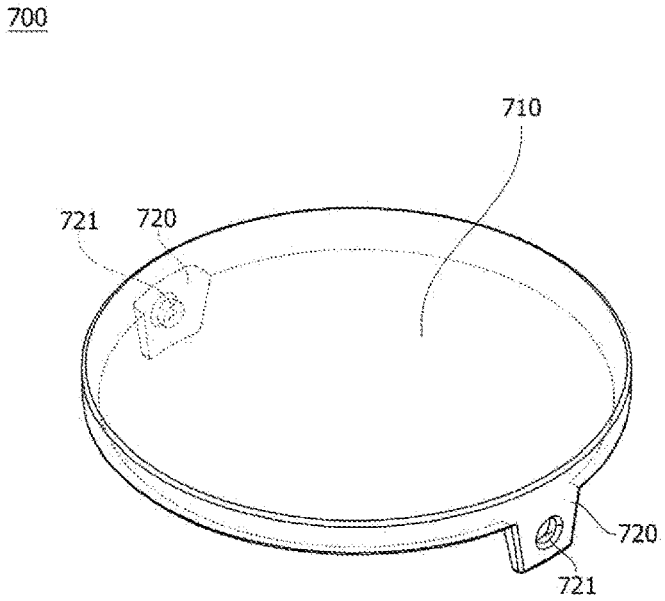
FIG. 23 is a view of a cover of the lighting device in accordance with an embodiment.

The cover 700 may cover the opening of the housing 400 and may diffuse the light emitted from the light source module 100. Referring to FIG. 23, the cover 700 may include a cover body 710 and a cover leg 720. The cover body 710 may be provided to cover the opening of the housing 400. Accordingly, the cover body 710 allows the heat emitted from the light source module 100 to be emitted outside while preventing foreign substances from the outside.

A material of the cover 700 may include materials such as, e.g., glass, plastic, polypropylene (PP), polyethylene (PE), and polycarbonate (PC), but is not limited thereto. The cover body 710, as shown in FIG. 22, may have a circular plate shape. However, the shape of the cover body 710 may differ depending on a shape of the opening of the housing 400.

The cover leg 720 may protrude from the cover body 710. Also, the cover leg 720 may include a cover fastening hole 721 formed to be coupled with the third fastening member 40. Accordingly, the third fastening member 40 may pass through the cover coupling hole 480 to be coupled with the cover fastening hole 721, thereby fixing the cover 700 to the housing 400. The cover body 710 may include at least two cover legs 720.

Figure 24:
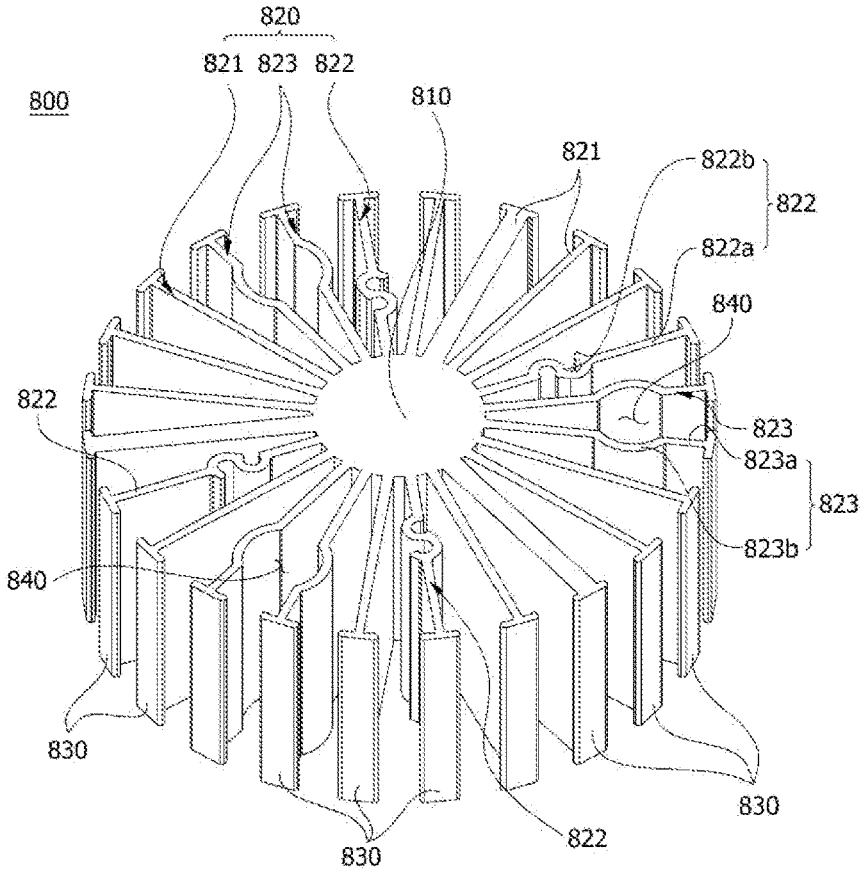
FIG. 24 is a perspective view of a heat sink of the lighting device in accordance with an embodiment.
Figure 26:
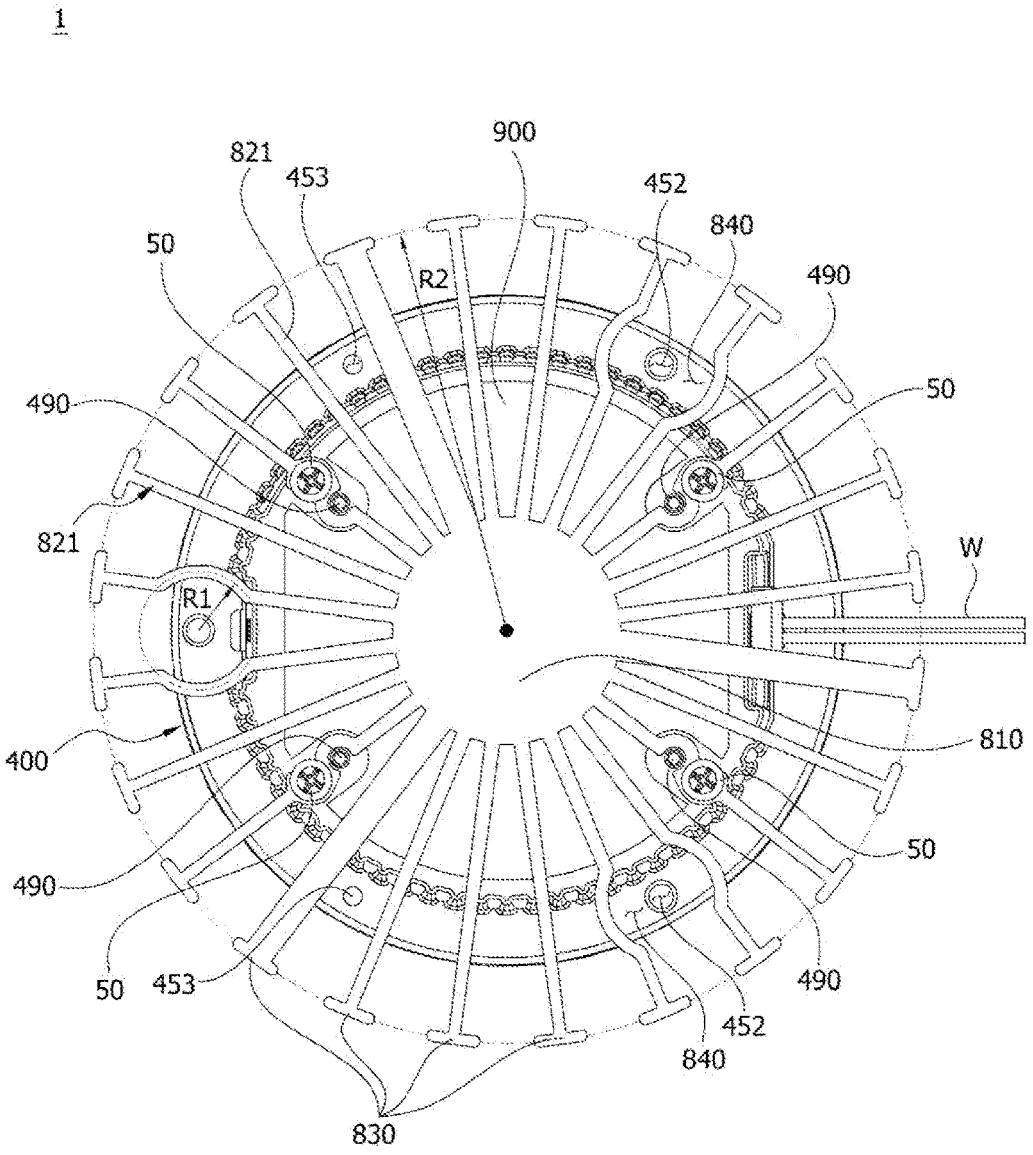

Referring to FIGS. 24 to 26, the heat sink 800 may be provided on one side or surface of the housing 400 to help the housing 400 emit heat. For example, the heat sink 800 may be provided at a bottom of the housing 400 for installation structure. Referring to FIG. 24, the heat sink 800 may include a heat sink body 810 and heat sinking plates 820. The heat sinking plates 820 may include a first heat sinking plate 821, a second heat sinking plate 822, and a third heat sinking plate 823. The heat sink 800 may further include a fourth heat sinking plate 830.

The heat sink body 810 may be formed in a cylindrical shape, but is not limited thereto, and may have a circular, oval, or polygonal cross section. The heat sink body 810 may have a truncated cone shape in which a top area may differ in size from a bottom area. Also, the heat sink body 810 may allow one side thereof to be in contact with the housing 400.

The heat sinking plate 820, as shown in FIG. 26, may extend and protrude from an outer circumferential surface 811 of the heat sink body 810. The heat sinking plates 820 may include the first heat sinking plate 821, the second heat sinking plate 822, and the third heat sinking plate 823.

Referring to FIGS. 24 to 26, the first heat sinking plate 821 may be formed to protrude radially from the heat sink body 810. The first heat sinking plate 821 may have a plate shape. The second heat sinking plate 822 may include a heat sinking portion 822*a*, which may have a plate shape and a first curved heat sinking portion 822*b*. As shown in FIG. 24, the first curved heat sinking portion 822*b* may be bent in one direction and bent in another direction based on a circumferential direction of the heat sink body 810. For example, the first curved heat sinking portion 822*b* may have an S shape. Also, the first curved heat sinking portion 822*b* may be formed between the two heat sinking portions 822*a*.

The heat sink guide member 490 may be assembled with one of bent areas formed by the first curved heat sinking portion 822*b* bent in one direction and the other direction and the fourth fastening member 50 may be provided in another area. As shown in FIG. 25, an end of the fourth fastening member 50 may be fastened to the heat sink fastening groove 491 and a head of the fourth fastening member 50 may pressurize one side of the first curved heat sinking portion 822*b* to fasten the housing 400 to the heat sink 800.

Referring to FIGS. 24 to 26, the third heat sinking plate 823 may include a heat sinking portion 823*a*, which may have a plate shape and a second curved heat sinking portion 823*b*. As shown in FIG. 24, the second curved heat sinking portion 823*b* may be bent in one direction based on the circumferential direction of the heat sink body 810. Also, the second curved heat sinking portion 823*b* may be formed between the two heat sinking portions 823*a*. The second curved heat sinking portion 823*b* may be formed with a certain curvature R1.

Due to the two third heat sinking plates 823 with the certain curvature R1, a work space 840 may be formed. As shown in FIG. 26, the two second curved heat sinking portions 823*b* may be provided on the same curvature R1, thereby forming the work space 840. A screw driver or other fastening tools may be inserted through the work space 840.

The fourth heat sinking plate 830, as shown in FIGS. 24 to 26, may be provided at an end of each of the first heat sinking plate 821, the second heat sinking plate 822, and the third heat sinking plate 823. The fourth heat sinking plate 830 may be formed with a certain curvature R2. The fourth heat sinking plate 830 formed with the certain curvature R2 may finish the end of each of the first heat sinking plate 821, the second heat sinking plate 822, and the third heat sinking plate 823, thereby minimizing damage to the heat sinking plates 821, 822, 823 and protecting the user from the ends of each of the heat sinking plates 821, 822, 823. The fourth heat sinking plate 830 may be provided at the end of each of the first heat sinking plate 821, the second heat sinking plate 822, and the third heat sinking plate 823 to increase a heat sinking area, thereby increasing heat sinking performance of the heat sink 800. The ends of the first heat sinking plate 821, the second heat sinking plate 822, and the third heat sinking plate 823 may be rounded, thereby protecting the user from the ends of each of the heat sinking plates 821, 822, 823.

The heat sink body 810, the heat sinking plate 820, and the fourth heat sinking plate 830 of the heat sink 800 may be integrally formed, but are not limited thereto. As shown in FIG. 25, a thermal conduction layer 900 may be further provided between the housing 400 and the heat sink 800 of the lighting device 1. For example, the thermal conduction layer 900 may be thermal grease or a thermal pad.

Figure 27:
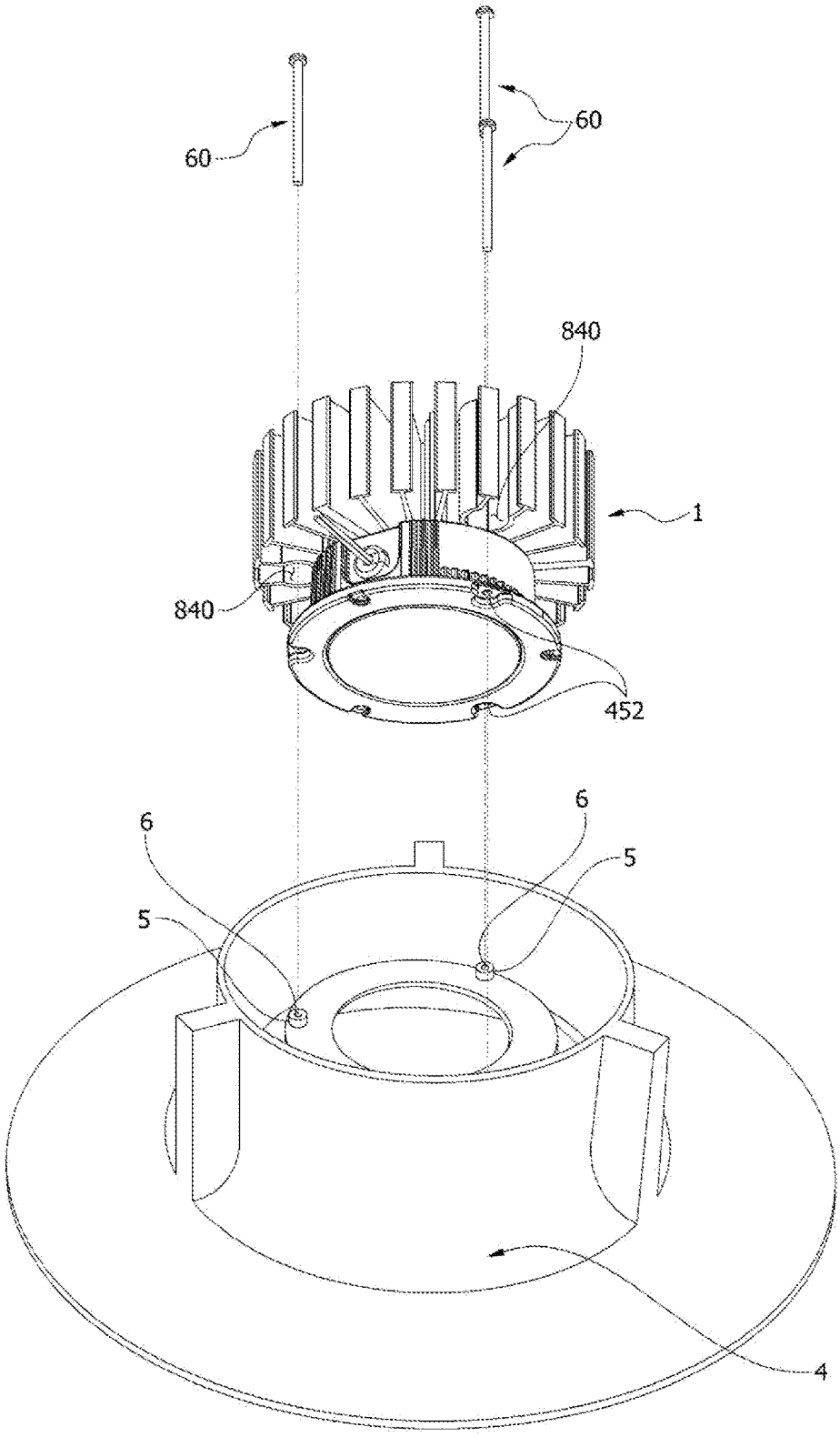
FIG. 27 is a view illustrating a coupling between the lighting device and a frame in accordance with an embodiment.

Referring to FIGS. 26 and 27, the lighting device 1 may be installed in a frame 4 as a downlight. As shown in FIG. 27, to be coupled with the lighting device 1, the frame 4 may include a guide protrusion 5 to be coupled with the mounting step groove 454. The guide protrusion 5 may include a guide protrusion groove 6 formed at an end thereof. When the lighting device 1 is installed in the frame 4, the guide protrusion groove 6 may be connected with the mounting hole 452. Accordingly, the lighting device 1 may be fixedly installed in the frame 4 using a fifth fastening member or fastener 60 that passes through the mounting hole 452 and may be coupled with the guide protrusion groove 6. An end of the fifth fastening member 60 may be fastened to the guide protrusion groove 6 connected with the mounting hole 452 using the screw driver or other fastening tool inserted through the work space 840.

According to embodiments disclosed herein, a holder and a lighting device including the same may increase a heat sinking function of a heat sink while arranging wires provided therein. The lighting device may be installed on a ceiling as a downlight type lighting. The holder installed in the lighting device may include an inclined surface and a supporting portion to support a reflector. The holder may include a channel formed with a certain curvature to easily arrange the wires. The holder may support a reflector while arranging wires electrically connected to a light source module and a lighting device including the same.

Embodiments disclosed herein provide a holder including a holder body having a hole, an outlet formed or provided in a side of the holder body, and a channel formed or provided in the holder body to connect the hole with the outlet. The channel may include a first channel formed or provided in a circumferential direction and having one side connected to the outlet, a second channel that guides one of two wires connected to a light source module to the first channel, and a third channel that guides another one of the two wires to the first channel. A corner where or at which the first channel meets the second channel or the first channel meets the third channel may be rounded. The channel may be formed in a groove shape with an opening formed therein.

The holder may further include a separation preventing protrusion that protrudes from the opening of the channel. The holder body may include an inclined surface provided around the hole and a supporting portion that extends along the inclined surface and protrudes therefrom. A holder coupling hole formed in the light source module may be assembled with a coupling portion formed or provided on the holder body.

Embodiments disclosed herein provide a lighting device including a housing, a holder provided in the housing, and a thermal pad provided between the holder and the housing. The holder may include a holder body having a hole, an outlet formed or provided in a side of the holder body, and a channel formed in the holder body to connect the hole with the outlet. The channel may include a first channel formed or provided in a circumferential direction and having one side connected to the outlet, a second channel that guides one of two wires connected to a light source module to the first channel, and a third channel that guides another of the two wires to the first channel.

The thermal pad may be provided in a preset position due to a guide rib formed or provided on the holder body, and the guide rib may be assembled with a guide rib coupling hole provided in the housing. The thermal pad may be divided into a contact area and a noncontact area depending on contact with the light source module, and the noncontact area may be spaced apart from the holder.

The lighting device may further include a wire bushing provided on one side of the housing. The wire bushing may include a wire bushing body with a wire through hole formed therein and a wire guide member provided on one side of the wire bushing body to form a wire guide hole. The wire may pass through the wire guide hole and the wire through hole.

The lighting device may include a heat sink provided on one side of the housing. The heat sink may include a heat sink body and a plurality of heat sinking plates, which may extend from an outer circumferential surface of the heat sink body. The heat sinking plates may include a first heat sinking plate, which may have a plate shape, and a second heat sinking plate, which may include a heat sinking portion with a plate shape and a first curved heat sinking portion bent in one direction and then in another direction.

The heat sinking plates may include a third heat sinking plate, which may include a second curved heat sinking portion bent with a certain curvature. The heat sink may include a work space formed by two second curved heat sinking portions on a same curvature that face each other. The heat sink may further include a fourth heat sinking plate with a certain curvature provided at an end of each of the plurality of heat sinking plates.

Embodiments disclosed herein provide a lighting device including a housing, a holder provided in the housing, and a thermal pad provided between the holder and the housing. The holder may include a holder body having a hole, an outlet formed or provided in a side of the holder body, and a channel formed in the holder body to connect the hole with the outlet. The housing may include a housing body with an opening formed in one side thereof and a plurality of serrations formed or provided on an outer circumferential surface of the housing body. The serrations may include a first serration that protrudes from one edge to another edge of the housing body, and a second serration that protrudes a certain length from the one edge or the other edge of the housing body.

The lighting device may further include a flange portion formed or provided at an end of the opening of the housing body. The flange portion may include a flange body and a plurality of mounting holes and a plurality of trim holes formed in the flange body. A trim step groove may be concavely formed around the trim hole.

The housing may further include a first guide member or guide and a second guide member or guide provided on an inner circumferential surface of the housing body to be spaced apart from each other and to protrude inward, and a guide portion, which may include a coupling space provided between the first guide member and the second guide member. A guide protrusion that protrudes from a side of the holder may be guided by the coupling space. The coupling space may have a shape in which one side has a greater width than another side.

A plurality of second serrations may be provided along one edge of the housing. The channel may include a first channel provided in a circumferential direction and having one side connected to the outlet, a second channel that guides one of two wires connected to a light source module to the first channel, and a third channel that guides another of the two wires to the first channel.

It will be understood that although the terms "first", "second", etc. may be used herein to describe various components, these components should not be limited by these terms. These terms are used merely to distinguish one element from another. For example, without departing from the scope of the present disclosure, a second component may be designated as a first component, and similarly, the first component may be designated as the second component. The term "and/or" includes any and all combinations or one of a plurality of associated listed items.

When a component is referred to as being "connected to" another component, it may be directly or indirectly connected to the other component. That is, for example, intervening components may be present. On the contrary, when a component is referred to as being "directly connected to" another component, it may be understood that there are no intervening components. When an element is referred to as being "formed on or under" another element, it may be directly or indirectly formed on or under the other element. That is, one or more intervening elements may be present. Also, the terms on or under may not only mean an upward direction but also a downward direction based on one element.

Singular expressions, unless defined otherwise in contexts, include plural expressions. Throughout the specification, the terms "comprise" or "have", etc. are used herein specify the presence of stated features, numbers, steps, operations, elements, components or combinations thereof but do not preclude the presence or addition of one or more other features, numbers, steps, operations, elements, components, or combinations thereof. Throughout the specification, like reference numerals designate like elements and a repetitive description thereof may be omitted.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a housing;

a holder provided in the housing;

a thermal pad disposed between the holder and the housing; and a heat sink disposed on a bottom of the housing, wherein the holder comprises:

a holder body with a hole formed therein;

an outlet formed in a side of the holder body; and a channel formed in the holder body to connect the hole with the outlet, and wherein the channel comprises:

a first channel which is formed in a circumferential direction and has one side connected to the outlet;

a second channel formed to guide one of two wires connected to a light source module to the first channel; and a third channel formed to guide the other one of the two wires to the first channel, wherein the heat sink comprises:

a heat sink body; and a plurality of heat sinking plates which are disposed on an outer circumferential surface of the heat sink body while extending therefrom, wherein the heat sinking plates comprise:

a first heat sinking plate having a plate shape; and a second heat sinking plate that includes a first heat sinking portion having a plate shape, a second heat sinking portion having a plate shape, and a first curved heat sinking portion provided between the first heat sinking portion and the second heat sinking portion, wherein the first curved heat sinking portion includes a first bent area bent in a first direction and a second bent area bent in a second direction opposite to the first direction, and wherein the first bent area provided by the first curved heat sinking portion is assembled with a heat sink guide member provided on a bottom surface of the housing, wherein the first bent area and the second bent area comprise a shape of an S, wherein the first bent area is a concave curve from a first end to a second end, and the second bent area is a convex curve from a third end to a fourth end, wherein the first end of the first bent area is to contact the first heat sinking portion, the second end of the first bent area is to contact the third end of the second bent area, and the fourth end of the second bent area is to contact the second heat sinking portion.

2. The lighting device of claim 1, wherein the thermal pad is disposed in a preset position due to a guide rib formed on the holder body, and the guide rib is assembled with a guide rib coupling groove formed in the housing.

3. The lighting device of claim 1, wherein the thermal pad has a contact area and a noncontact area, and whether any given portion of the thermal pad lies within the contact area or the noncontact area depends on whether or not that portion of the thermal pad is in contact with the light source module or not.

4. The lighting device of claim 1, further comprising a wire bushing disposed on one side of the housing, wherein the wire bushing comprises:

a wire bushing body with a wire through hole formed therein; and a wire guide member disposed on one side of the wire bushing body to form a wire guide hole, and wherein the wire passes through the wire guide hole and further is disposed through the wire through hole.

5. The lighting device of claim 1, wherein the heat sinking plates further comprise a third heat sinking plate which comprises a second curved heat sinking portion bent with a certain curvature (R1).

6. The lighting device of claim 5, comprising a work space formed by the second curved heat sinking portion and the third curved heat sinking portion disposed so as to lie on the same curvature.

7. The lighting device of claim 6, further comprising a fourth heat sinking plate formed with a certain curvature at an end of each of the heat sinking plates.

8. The lighting device of claim 1, wherein the housing comprises:

a housing body with an opening formed in one side thereof; and a plurality of serrations formed on an outer circumferential surface of the housing body, and wherein the serrations comprise:

a first serration formed to protrude from a first edge to a second edge of the housing body; and a second serration formed to protrude with a certain length from the first edge or the second edge of the housing body.

9. The lighting device of claim 8, further comprising a flange portion formed at an end of the opening of the housing body, wherein the flange portion comprises:

a flange body;

a plurality of mounting holes formed in the flange body; and at least one trim hole formed in the flange body, and wherein a trim step groove is concavely formed around the at least one trim hole.

10. The lighting device of claim 9, wherein the housing further comprises:

a first guide member and a second guide member formed on an inner circumferential surface of the housing body to be spaced apart from each other and to protrude inward; and a guide portion, which comprises a coupling space formed between the first guide member and the second guide member, and wherein a guide protrusion formed on a side of the holder to protrude therefrom is guided by the coupling space.

11. The lighting device of claim 10, wherein the coupling space has a shape which has a first side with a greater width and a second side with a smaller width.

12. The lighting device of claim 8, wherein a plurality of the second serrations are disposed along one edge of the housing.

13. The lighting device of claim 8, wherein the channel comprises:

a first channel which is formed in a circumferential direction and has one side connected to the outlet;

a second channel formed to guide one of two wires connected to a light source module to the first channel; and a third channel formed to guide the other of the two wires to the first channel.

14. The lighting device of claim 1, wherein the heat sink guide member is assembled with the first bent area of the first curved heat sinking portion, and a fastening member is assembled with respect to the second bent area of the first curved heat sinking portion.

15. The lighting device of claim 14, wherein a heat sink fastening groove is provided on the bottom surface of the housing, and an end of the fastening member is to fasten with the heat sink fastening groove.

16. The lighting device of claim 1, comprising a fastening member, the fastening member is to pressurize one side of the first curved heat sinking portion to fasten the housing to the heat sink.

17. The lighting device of claim 1, wherein the first heat sinking portion, the first end of the first bent area, the second end of the first bent area, the third end of the second bent area, the fourth end of the second bent area, and the second heat sinking portion are all aligned along an imaginary straight line.

* * * * *